US012692680B2

(12) United States Patent
Wilson et al.

(10) Patent No.: US 12,692,680 B2
(45) Date of Patent: Jul. 28, 2026

(54) STRUCTURAL PLATES AND METHODS OF CONSTRUCTING ARCH-SHAPED STRUCTURES USING STRUCTURAL PLATES

(71) Applicant: AIL International Inc., Sackville (CA)

(72) Inventors: Michael W. Wilson, Sackville (CA); Wayne W. Ford, Moncton (CA)

(73) Assignee: AIL International Inc., Sackville (CA)

( * ) Notice: Subject to any disclaimer, the term of this patent is extended or adjusted under 35 U.S.C. 154(b) by 0 days.

(21) Appl. No.: 18/849,913

(22) PCT Filed: Mar. 24, 2023

(86) PCT No.: PCT/CA2023/050402

§ 371 (c)(1),
(2) Date: Sep. 23, 2024

(87) PCT Pub. No.: WO2023/178450

PCT Pub. Date: Sep. 28, 2023

(65) Prior Publication Data

US 2025/0223774 A1 Jul. 10, 2025

Related U.S. Application Data

(60) Provisional application No. 63/323,382, filed on Mar. 24, 2022.

(51) Int. Cl.
*E02D 29/02* (2006.01)
*E04B 1/32* (2006.01)

(52) U.S. Cl.
CPC ..... *E02D 29/0241* (2013.01); *E04B 1/3205* (2013.01)

(58) Field of Classification Search
CPC ..... E02D 29/0241; E04B 1/3205; E01F 5/005
See application file for complete search history.

(56) References Cited

U.S. PATENT DOCUMENTS 2,343,029 A * 2/1944 Schmidt ..... E01F 5/005 138/106
4,993,872 A * 2/1991 Lockwood ..... E01F 5/005 405/125

(Continued)

FOREIGN PATENT DOCUMENTS

CA 2254595 C * 4/2008 ..... E02D 29/0225
JP H11190486 A 7/1999

(Continued)

OTHER PUBLICATIONS

European Patent Office, Extended European Search Report dated Mar. 3, 2025 for European Patent Application No. 23773419.9.

(Continued)

*Primary Examiner* — Benjamin F Fiorello
(74) *Attorney, Agent, or Firm* — Mintz Levin Cohn Ferris Glovsky and Popeo, P.C.

(57) ABSTRACT

A buried structure. The buried structure includes a pair of structural plates having corrugations extending transversely along a longitudinal direction of the buried structure, and a taper member configured to interconnect, via circumferential taper member edges, the pair of structural plates along respective circumferential structural plate edges. The taper member may have a taper member width progressively decreasing from a first longitudinal taper member edge to a second longitudinal taper member edge. The buried structure thereby configured to extend along the longitudinal direction in a non-linear path based on a separation distance between the adjacent circumferential structural plate edges of the respective structural plates corresponding to the progressively decreasing taper member width. The taper member may be substantially uncorrugated. The taper member may include a plurality of taper plates respectively sized (Continued)

to have taper plate widths progressively decreasing along the taper plate length.

19 Claims, 21 Drawing Sheets

(56) References Cited

U.S. PATENT DOCUMENTS

| | | | | |
|---|---|---|---|---|
| 4,997,317 | A | 3/1991 | Schoenfeld et al. | |
| 5,669,733 | A * | 9/1997 | Daly | E03F 1/003 138/155 |
| 6,474,907 | B2 * | 11/2002 | Semotiuk | E01F 5/005 405/126 |
| 6,592,293 | B1 * | 7/2003 | Hedstrom | E03F 1/003 138/155 |
| 8,596,910 | B2 * | 12/2013 | Semotiuk | E01F 5/005 405/126 |
| 10,378,164 | B2 | 8/2019 | Flint et al. | |
| 2009/0214297 | A1 | 8/2009 | Wilson | |
| 2018/0363810 | A1 * | 12/2018 | Smith | F16L 9/22 |

FOREIGN PATENT DOCUMENTS

| | | | |
|---|---|---|---|
| KR | 200410474 | Y1 | 3/2006 |
| WO | 2021072560 | A1 | 4/2021 |
| WO | 2023178450 | A1 | 9/2023 |

OTHER PUBLICATIONS

World Intellectual Property Organization, International Search Report and Written Opinion dated Jun. 7, 2023 for PCT patent application No. PCT/CA2023/050402.

* cited by examiner

STRUCTURAL PLATES AND METHODS OF CONSTRUCTING ARCH-SHAPED STRUCTURES USING STRUCTURAL PLATES

CROSS REFERENCE TO RELATED APPLICATIONS

This application is a National Stage Application filed under 35 U.S.C. § 371 of PCT Patent Application No. PCT/CA2023/050402, entitled "STRUCTURAL PLATES AND METHODS OF CONSTRUCTING ARCH-SHAPED STRUCTURES USING STRUCTURAL PLATES", filed on Mar. 24, 2023, which claims priority from U.S. provisional patent application No. 63/323,382, entitled "STRUCTURAL PLATES AND METHODS OF CONSTRUCTING ARCH-SHAPED STRUCTURES USING STRUCTURAL PLATES", filed on Mar. 24, 2022, the entire contents of which are hereby incorporated by reference herein.

FIELD

The present disclosure generally relates to structural plates, and in particular to interconnecting plate devices and methods for constructing buried structures from structural plates.

BACKGROUND

Structural plates may be constructed from a variety of materials, such as steel, aluminum, polycarbonate, or the like, and may be configured as flat plates, corrugated plates, or any other geometric configuration for providing structural support or transferring load forces.

Structural plates may be used to construct or support underpass systems, such as culverts, buried thoroughfares, tunnels, bridges, portals, or the like. As structural plate applications evolve to support longer or wider tunnels, heavier loads, higher stockpiles, or deeper portals, structural plates may be configured based on the environmental application.

SUMMARY

In an aspect, the present disclosure describes a buried structure. The buried structure may include: a pair of structural plates having corrugations extending transversely along a longitudinal direction of the buried structure; and a taper member configured to interconnect, via circumferential taper member edges, the pair of structural plates along respective circumferential structural plate edges, the taper member having a taper member width progressively decreasing from a first longitudinal taper member edge to a second longitudinal taper member edge, wherein the buried structure is configured to extend along the longitudinal direction in a non-linear path based on a separation distance between the adjacent circumferential structural plate edges of the respective structural plates corresponding to the progressively decreasing taper member width.

In some embodiments, the taper member may be substantially un-corrugated.

In some embodiments, the taper member includes a plurality of taper plates respectively sized to have taper plate widths progressively decreasing along the taper plate length, and wherein respective taper plates include a longitudinal taper plate edge positioned at an overlap interface with another longitudinal taper plate edge of an adjacent taper plate.

In some embodiments, the respective taper plates may be unfastened at the overlap interface from the adjacent taper plate.

In some embodiments, the taper member may be fastened at respective circumferential taper member edges to circumferential structural plate edges of adjacent structural plates.

In some embodiments, at least one longitudinal taper plate edge may include a transition feature having at least one of a raised or recessed edge.

In some embodiments, the taper member may include a combination of substantially planar taper plates and radiused along the taper member length to correspond to a radius of the structural plates.

In some embodiments, the taper member may be configured to have a substantially trapezoidal shape.

In some embodiments, the taper member thickness may be less than a structural plate thickness.

In some embodiments, the respective structural plates may include a plurality of structural plate apertures spaced along circumferential structural plate edges, and wherein the taper member may include a plurality of taper apertures spaced along circumferential taper member edges, and wherein the taper apertures may have a taper aperture spacing corresponding to a structural plate aperture spacing.

In some embodiments, the buried structure may include at least one tie-back member coupled to the taper member proximal to a foundation of the buried structure, the at least one tie-back member exerting force away from the buried structure.

In some embodiments, the taper member may be overlaid to interface with circumferential structural plate edges on an exterior side of the buried structure.

In another aspect, a taper member for securing a pair of structural plates for constructing a buried structure is described. The structural plates may have corrugations extending transversely along a longitudinal direction of the buried structure. The taper member may include: a first taper plate configured to interconnect, via circumferential taper member edges, the pair of structural plates along respective circumferential structural plate edges, the first taper plate having a taper plate width progressively decreasing from a first longitudinal taper plate edge to a second longitudinal taper plate edge; and an adjacent taper plate having an adjacent longitudinal taper plate edge positioned at an overlap interface with the second longitudinal taper plate edge, wherein the adjacent taper plate is configured to interconnect with the pair of structural plates along the respective circumferential structural plate edges, and wherein the respective taper plates are unfastened at the overlap interface from the adjacent taper plate.

In some embodiments, the first taper plate and the adjacent taper plate are substantially un-corrugated plates.

In some embodiments, the taper member may be fastened at respective circumferential taper member edges to circumferential structural plate edges of adjacent structural plates.

In some embodiments, the first taper plate and the adjacent taper plate may be substantially planar plates and radiused along the taper member length to correspond to a radius of the structural plates.

In some embodiments, the first taper plate or the adjacent taper plate may be configured to have a substantially trapezoidal shape.

In some embodiments, the taper member thickness may be less than a structural plate thickness.

In some embodiments, the taper member may be overlaid to interface with circumferential structural plate edges on an exterior side of the buried structure.

In some embodiments, the taper member may be laid to interface with circumferential structural plate edges on an interior side of the buried structure.

In another aspect, a method of constructing a buried structure is provided. The method includes: constructing a plurality of structural rings, the structural rings including structural plates coupled at longitudinal structural plate edges of an adjacent longitudinal structural plate edge, the structural plates having corrugations extending transversely along a longitudinal direction of the buried structure; positioning the plurality of structural rings adjacent to another structural ring; and positioning a taper member to interconnect, via circumferential taper member edges, the pair of structural plates along respective circumferential structural plate edges, the taper member having a taper member width progressively decreasing from a first longitudinal taper member edge to a second longitudinal taper member edge, wherein the buried structure is configured to extend along the longitudinal direction in a non-linear path based on a separation distance between the adjacent circumferential structural plate edges of the respective structural plates corresponding to the progressively decreasing taper member width.

In some embodiments, the taper member may be substantially un-corrugated.

In some embodiments, the method includes: positioning a plurality of taper plates respectively sized to have taper plate widths progressively decreasing along the taper plate length for assembling the taper member, wherein respective taper plates include a longitudinal taper plate edge positioned at an overlap interface with another longitudinal taper plate edge of an adjacent taper plate.

In some embodiments, the respective taper plates may be unfastened at the overlap interface from the adjacent taper plate.

In some embodiments, the method includes: fastening at respective circumferential taper member edges the taper member to circumferential structural plate edges of adjacent structural plates.

In some embodiments, the taper member may include a combination of substantially planar taper plates and radiused along the taper member length to correspond to a radius of the structural plates.

In some embodiments, the taper member thickness may be less than a structural plate thickness.

In some embodiments, the respective structural plates may include a plurality of structural plate apertures spaced along circumferential structural plate edges, wherein the taper member includes a plurality of taper apertures spaced along circumferential taper member edges, wherein the taper apertures have a taper aperture spacing corresponding to a structural plate aperture spacing, and wherein the method includes: inserting fasteners within respectively aligned structural plate apertures and taper apertures to fasten, via the taper member, the pair of structural plates along respective circumferential structural plate edges.

In some embodiments, the method includes: securing at least one tie-back member coupled to the taper member proximal to a foundation of the buried structure, the at least one tie-back member exerting force away from the buried structure.

In this respect, before explaining at least one embodiment in detail, it is to be understood that the embodiments are not limited in application to the details of construction and to the arrangements of the components set forth in the following description or illustrated in the drawings. Also, it is to be understood that the phraseology and terminology employed herein are for the purpose of description and should not be regarded as limiting.

Many further features and combinations thereof concerning embodiments described herein will appear to those skilled in the art following a reading of the present disclosure.

DESCRIPTION OF THE FIGURES

In the figures, embodiments are illustrated by way of example. It is to be expressly understood that the description and figures are only for the purpose of illustration and as an aid to understanding.

Embodiments will now be described, by way of example only, with reference to the attached figures, wherein in the figures.

DETAILED DESCRIPTION

Buried structures may be constructed based on a combination of interconnected structural plates. Buried structures may include arch-shaped structures or box-shaped structures, among other examples, and may include culverts, buried thoroughfares, tunnels, bridges, or portals. In some examples, structural plates may be flat, may be corrugated, or may have other configurations.

In some examples, respective structural plates may have a radius, or may have other structural shapes for forming a portion of buried structures. In some examples, buried structures may have a circular arch cross-section profile, such that respective structural plates may have a substantially similar radius profile. In some examples, buried structures may have a cross-sectional profile including at least two distinct curvatures, such that as box-shaped structures or other configurations having multi-radius shapes.

Buried structures may include a combination of interconnected structural plates configured to withstand load forces or to transfer thrust forces among the plurality of interconnected structural plates according to a specification.

Structural plates may be interconnected with adjacent structural plates along longitudinal edges or circumferential edges. In some examples, adjacent plates may be joined by lapping adjacent longitudinal edges or adjacent circumferential edges, and inserting fastening bolts into plate apertures positioned proximal to the plate edges. As applications of structural plates evolve for constructing wider bridge underpasses, for withstanding heavier loads, for supporting higher stockpiles, or for constructing deeper portals, it may be beneficial to strengthen such structural plates while maintaining configurability of combined structural plates.

Buried structures may extend in a longitudinal direction. For example, a longitudinal direction of a buried structure may be a direction of the structure axis that is parallel to the locus of the crown. The crown of the buried structure may be the highest point on a curved soffit.

It may be beneficial to provide devices for interconnecting structural plates such that buried structures may extend along a non-linear path (e.g., for winding around obstacles, for tracking curvature of land, among other example scenarios), whilst maintaining configurability to withstand load forces or to transfer thrust forces among the plurality of interconnected structural plates according to desired specifications.

Figure 1:
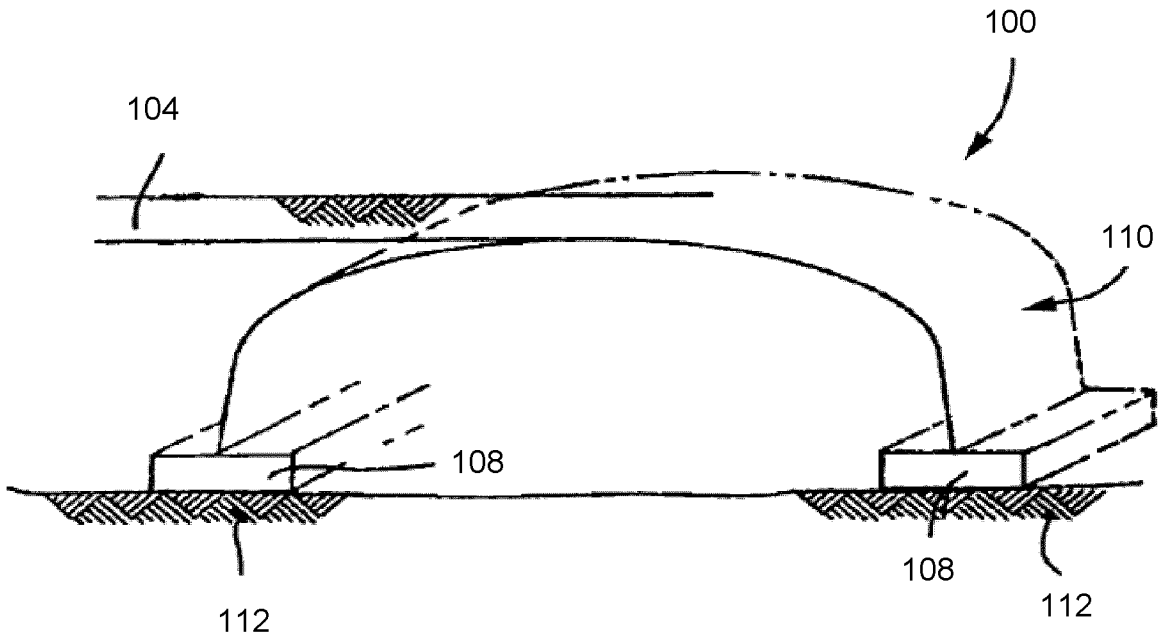
FIG. 1 illustrates an underpass system, in accordance with an embodiment of the present disclosure.

Reference is made to FIG. 1, which illustrates an underpass system 100, in accordance with an embodiment of the present disclosure. The underpass system 100 may be a buried bridge system, a thoroughfare infrastructure system, among other examples. The underpass system 100 may include a buried structure 110 constructed of interconnected structural plates or sheets. In some embodiments, the interconnected plates may be corrugated structural plates. In some embodiments, the structural plates may be constructed of metal. Other types of material or configurations of plates or sheets may be contemplated.

In the example illustrated in FIG. 1, the buried structure 110 is illustrated to be a box-shaped structure and has an "open-bottom". Other types of buried structures may be contemplated, such as closed-bottom structures, where the buried structures may form a culvert or similar structure. Closed-bottom structures may have cross-sectional profiles that may be circular, elliptical, or other shapes.

The buried structure 110 may include a prescribed depth of overburden 104, on top of which is a roadway or other physical structure. In some examples, the buried structure 110 may include a shallow foundation 108, a deep foundation, and a metal archway 110. The foundation may be placed atop compacted fill 112.

In some scenarios, the buried structure 110 may be configured to withstand loads, and may be subject to a plurality of forces. For example, the buried structure 110 may be configured to resist bending forces that might otherwise result in structural plate deformation.

In some scenarios, the buried structure 110 may be configured to transfer thrust forces towards a foundation 108. Thrust forces may include circumferential compressive force experienced by the buried structure 110 under a load.

In some scenarios, the buried structure 110 may be configured to resist shear forces, such that respective structural plates of an assembled combination of structural plates are not torn apart from another.

In other scenarios, the buried structure 110 may be configured to resist other types of forces when subjected to a load.

Figure 2:
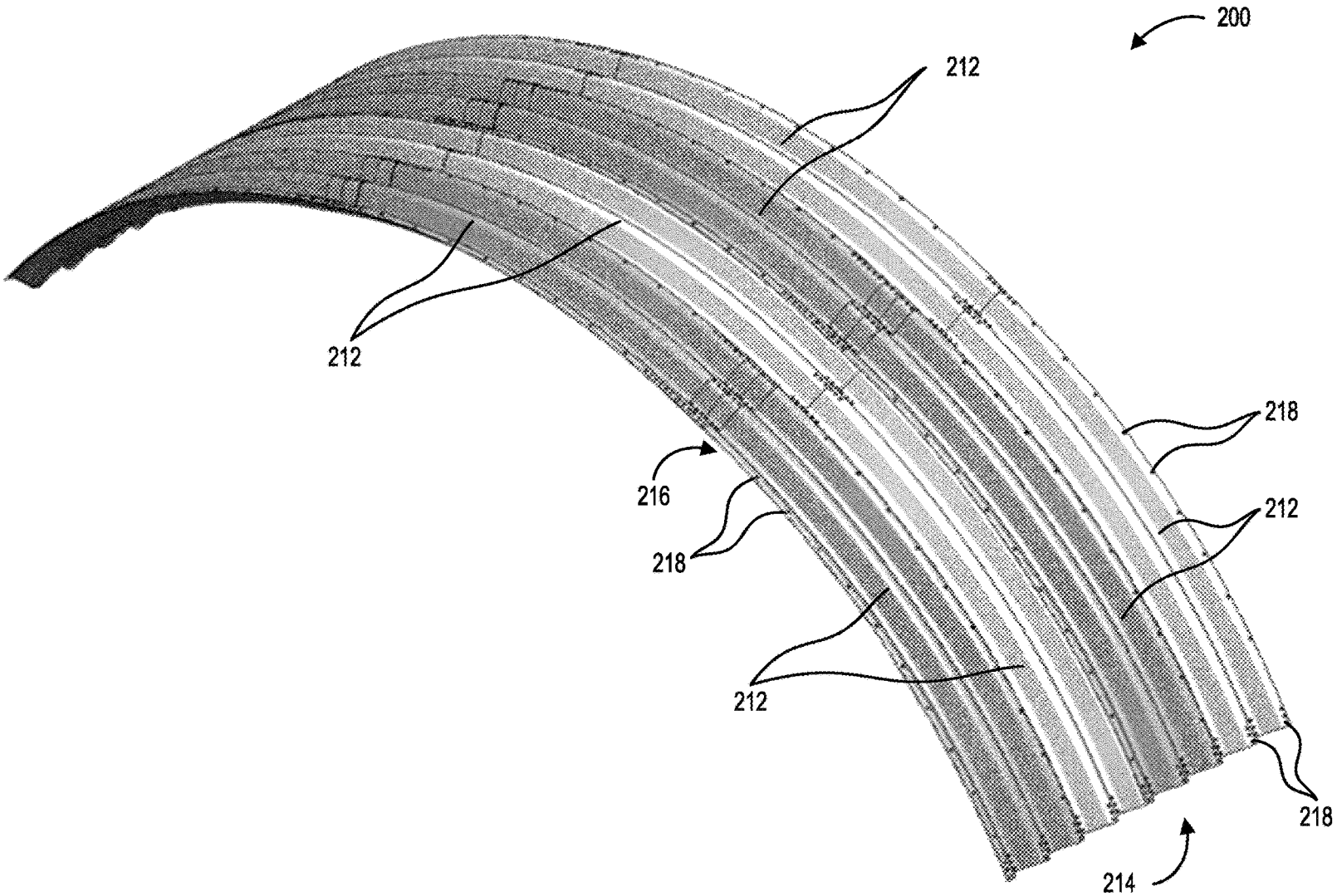
FIG. 2 illustrates a partial perspective view of a buried structure, in accordance with an embodiment of the present disclosure.

Reference is made to FIG. 2, which illustrates a partial perspective view of a buried structure 200, in accordance with an embodiment of the present disclosure. The buried structure 200 may include a plurality of interconnected structural plates 212. The structural plates 212 may be metal plates or may be structural plates constructed of other materials.

In some embodiments, the structural plates 212 may be corrugated plates having corrugations. When the structural plates 212 are combined and assembled to form the buried structure 200, the corrugations may extend transversely of a longitudinal length of the buried structure 200. In some scenarios, the corrugations of the structural plate 212 may be configured to resist bending forces acting upon the structural plate 212.

The respective structural plates 212 may include one or more apertures 218 along a longitudinal edge 214 or along a circumferential edge 216 of the respective structural plates 212. In some embodiments, the one or more apertures 218 may be configured to receive fasteners, such as bolt fasteners.

In some embodiments, when longitudinal ends 214 or circumferential ends 216 are lapped with adjacent structural plates 212 along a longitudinal end 214 or a circumferential end 216 of the adjacent structural plate, the structural plates 212 may be interconnected by the fasteners received within aligning apertures 218. Alternate fastening devices meeting structural and/or load requirements may also be used.

As will be described in the present disclosure, embodiments of joining members may be configured to secure adjacent structural plates 212 in non-overlapping arrangements at circumferential edges or longitudinal edges to form the buried structure 200.

In the example illustrated in FIG. 2, the respective structural plates 212 may be configured to have a radius, such that interconnection of the plurality of structural plates 212 may provide an overall arch-shape. The arch-shape may be a sole-radius arch, a multi-radius arch, a box culvert arch, or other single or multi-radius arch configuration, among examples.

In some embodiments, when a plurality of structural plates 212 are interconnected with adjacent structural plates along the longitudinal ends 214, the plurality of structural plates 212 may form a structural ring. In some scenarios, a given structural ring may be fastened to an adjacent structural ring by interconnecting along circumferential edges of the respective structural rings. In some scenarios, interconnecting a plurality of structural rings along circumferential edges may provide a buried structure in a longitudinal direction of the structure. The longitudinal direction may be the direction of the buried structure axis that is parallel to the locus of the structure crown. To illustrate, reference is made to FIG. 3, which illustrates a front, elevation view of a buried structure 300, in accordance with embodiments of the present disclosure.

Figure 3:
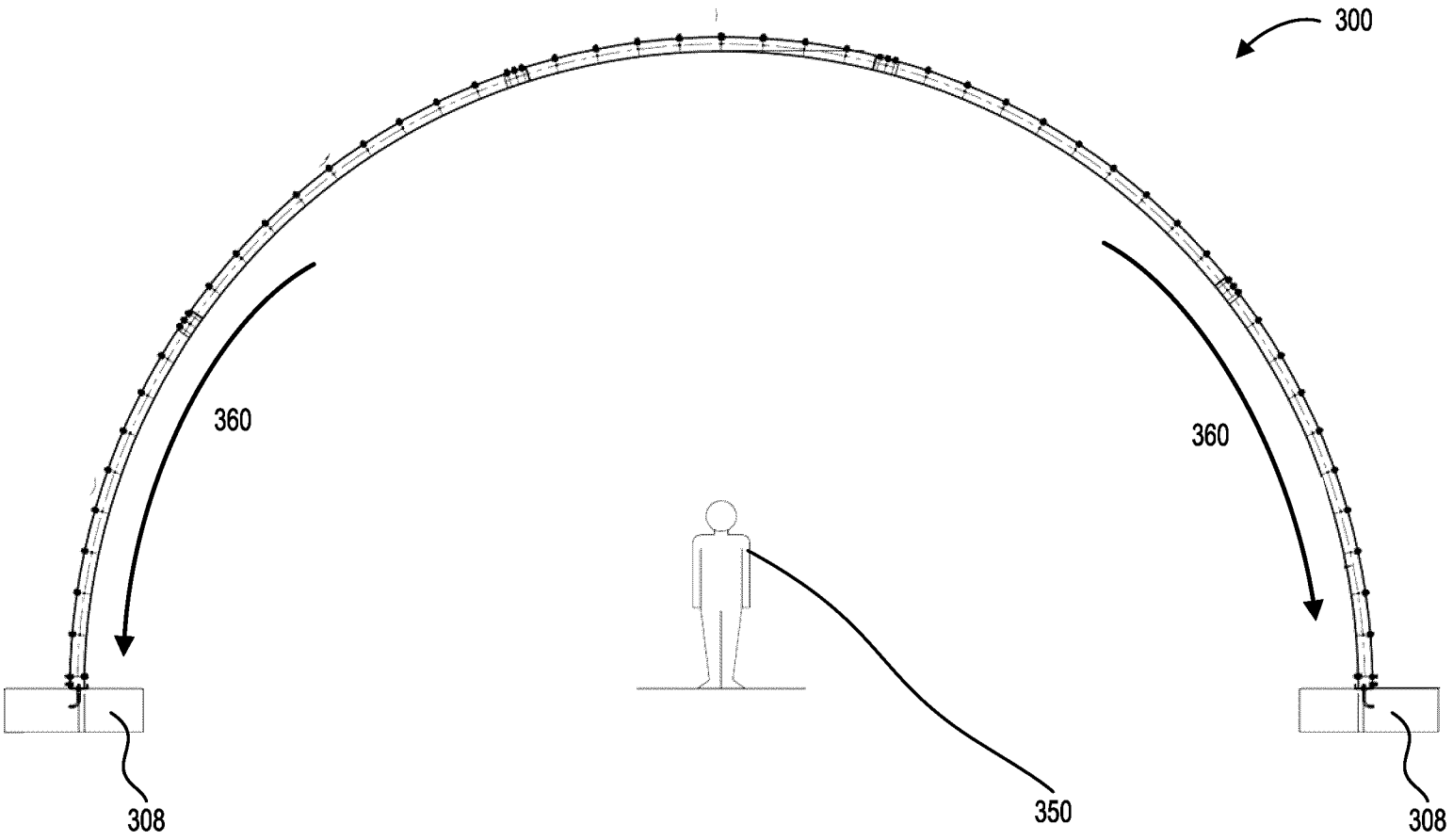
FIG. 3 illustrates a front, elevation view of a buried structure, in accordance with an embodiment of the present disclosure.

In FIG. 3, a user 350 may be positioned at an end or within the buried structure 300. The buried structure 300 may be assembled by interconnecting a plurality of structural rings, and the buried structure 300 may extend along a longitudinal direction path. In FIG. 3, the longitudinal path may be in a direction that is into the page of FIG. 3. Thus, the buried structure 300 extends along a substantially linear path, where the user may have a view of the end (or other side) of the opening of the buried structure 300.

In some embodiments, buried structures may be configured to resist or transfer one or more forces to an adjoining structure. As described, the buried structure 300 may be configured to transfer thrust forces 360 towards one or more foundations 308. As a general illustration, the thrust forces 360 may be the circumferential compressive force experienced by the assembled combination of structural plates when the buried structure 300 may be under load.

In some scenarios, it may be desirable to configure a combination of structural plates to provide a buried structure that extends in a non-linear, longitudinal path. The buried structure extending along a non-linear longitudinal path may be configured around obstacles or for tracking a curvature of land, among other examples.

In some examples, a buried structure configured to extend along a non-linear path may be constructed by welding cut structural plates to adjacent structural plates to form the buried structures. In some scenarios, such operations may include welding mitered structural plates.

In some examples, the buried structures may include concrete collars for reinforcing welded mitered structural plates. In some examples, constructing buried structures extending along non-linear paths based on welding mitered structural plates or by reinforcing with concrete collars may not provide desired structural integrity for withstanding load forces or for transferring thrust forces among a plurality of interconnected structural plates.

It may be desirable to provide structural plates for constructing buried structures that extend along non-linear paths and that may provide a desired structural integrity for withstanding load forces or other types of forces.

In some scenarios, it may be desirable to construct buried structures that extend along non-linear paths according to a repeatable path, as opposed to welding mitered structural plates cut to size at an installation site.

Figure 4:
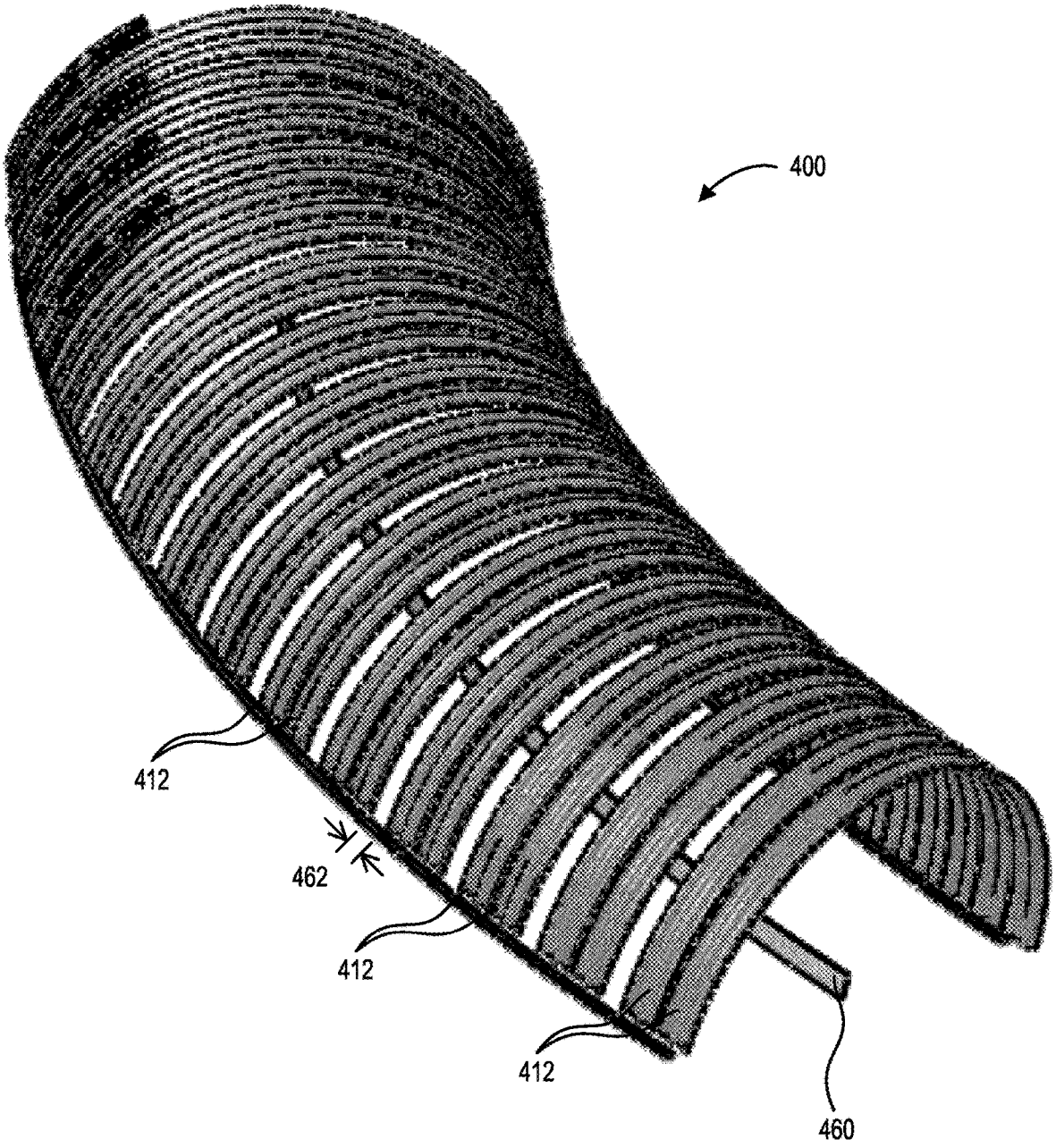
FIG. 4 illustrates a perspective view of a buried structure, in accordance with embodiments of the present disclosure.

Reference is made to FIG. 4, which illustrates a perspective view of a buried structure 400, in accordance with embodiments of the present disclosure.

The buried structure 400 may include a plurality of structural plates 412 configured to form structural rings. The structural rings may be configured by interconnecting respective structural plates 412 with an adjacent structural plate 412 at plate longitudinal ends. In some embodiments, the structural rings may be interconnected with an adjacent structural ring along a circumferential end of the structural plates 412.

In FIG. 4, the buried structure 400 may be configured to extend along a non-linear path 460. To configure the buried structure 400 to extend along the non-linear path 460, one or more groups of structural rings may be positioned apart from adjacent structural rings for configuring the buried structure 400 to extend in a non-linear path 460.

As an example, a given structural ring may be positioned such that: a first portion of a circumferential edge may be positioned a separation distance 462 from a corresponding circumferential edge portion of an adjacent structural ring; and a second portion of the circumferential edge may be proximal or in non-overlapping abutment to a further corresponding circumferential edge portion of the adjacent structural ring.

As will be described in the present disclosure, a taper member may be configured to secure adjacent structural plates in the non-overlapping arrangement at one or more circumferential edges of the pair of structural plates to form the buried structure extending along the non-linear path 460.

In the example of FIG. 4, the structural rings are illustrated as being grouped in pairs, and may be configured to include portions of circumferential edges spaced apart (e.g., by the separation distance 462) from corresponding portions of circumferential edges of an adjacent structural ring.

In other examples, any number of structural ring group configurations may be used. For example, the structural rings may be configured such that each successive structural ring may be positioned to have a portion of the circumferential edge spaced apart from that of an adjacent structural ring. In other examples, the structural rings may be grouped in any other numbers, and configured such that the structural ring groups may be positioned to have a portion of a circumferential edge spaced apart from that of an adjacent structural ring for receiving a taper member.

Figure 5:
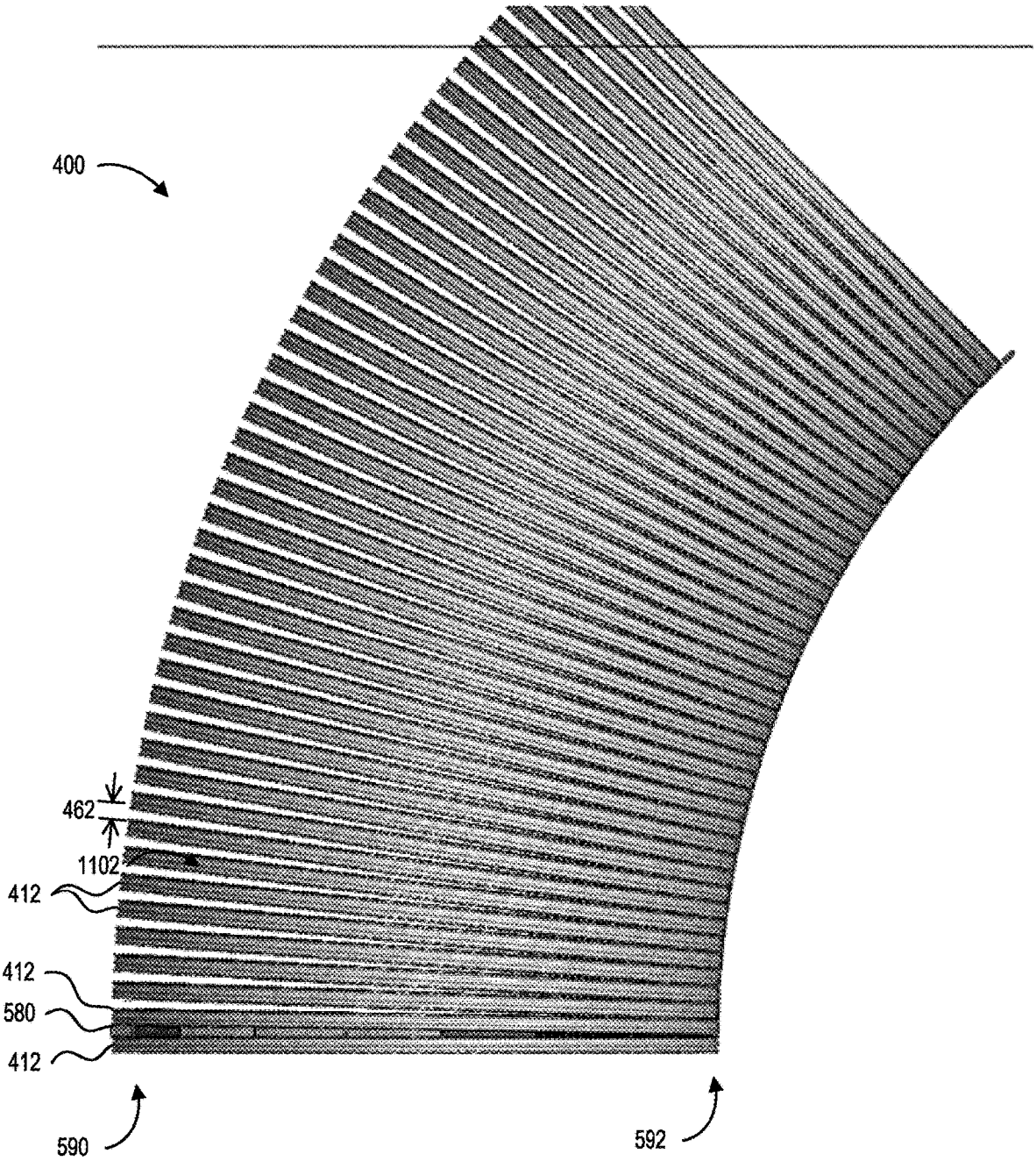
FIG. 5 illustrates a top, plan view of the buried structure of FIG. 4.

Reference is made to FIG. 5, which illustrates a top, plan view of the buried structure 400 of FIG. 4.

In FIG. 5, the buried structure 400 includes a taper member 580 configured to secure adjacent structural plates 412 along respective circumferential edges to form the buried structure 400. The taper member 580 may be configured to secure one of the circumferential edges distal from another of the circumferential edges by the separation distance 462. The separation distance 462 may vary from a first end 590 of the circumferential edge to another end 592 of the circumferential edge. For example, along the respective circumferential edges, the separation distance 462 between structural plates may decrease from one end of the circumferential edge to another end of the circumferential edge.

In some embodiments, the taper member 580 may be configured to secure adjacent structural plates 412 in non-overlapping arrangement at respective circumferential edges of the adjacent structural plates 412.

The combination of a series of adjacent structural plates 412 or adjacent groups of structural plates 412 and one or more taper members 580 may form the buried structure along a non-linear longitudinal path.

For ease of exposition, a single taper member 580 is illustrated in FIG. 5; however, the buried structure 400 may be configured to include a plurality of taper members 580 configured at a plurality of positions for securing adjacent structural plates 412 in non-overlapping arrangement to form the buried structure extending along a non-linear path.

Figure 6:
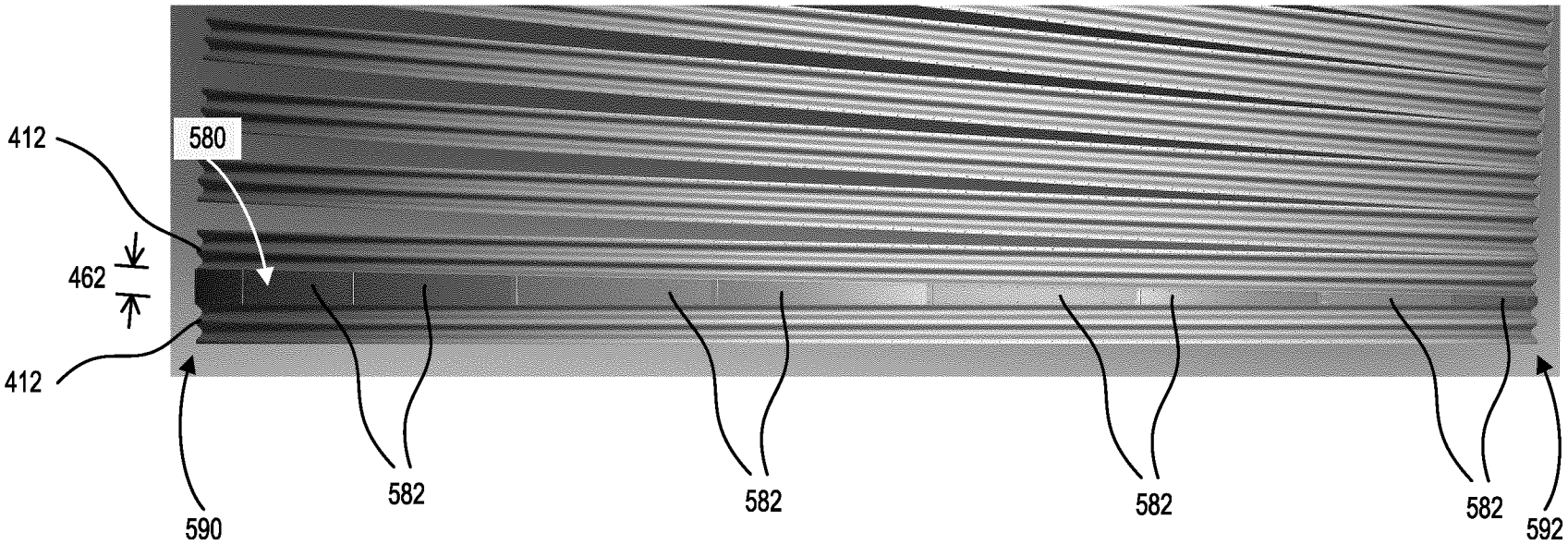
FIG. 6 illustrates an enlarged, partial top view of the buried structure of FIG. 4.

Reference is made to FIG. 6, which illustrates an enlarged, partial top-view of the buried structure 400 of FIG. 4.

More particularly illustrated in FIG. 6, the taper member 580 may include a plurality of taper plates 582 successively coupled to an adjacent taper plate along longitudinal taper edges. The combination of the adjacent taper plates may provide a wedge-shaped taper member 580 for securing combination of structural plates 412 (e.g., forming a structural ring) to an adjacent combination of structural plates 412.

In some embodiments, the taper member 580 may include opposing longitudinal edges having juxtaposed dimensions to provide a wedge-shaped taper member. For example, the respective taper plates 582 may be configured with decreasing longitudinal widths for occupying varying distance between portions of circumferential edges of adjacent structural rings. Examples are illustrated in subsequent drawings of the present disclosure.

In some embodiments, the wedge-shaped taper member 580 may be configured in the form of a trapezoid, such that successive portions of the wedge-shaped taper member 580 may occupy varying distance between portions of circumferential edges of structural rings. In some embodiments, the wedge-shaped taper member 580 may be triangular-shaped.

Figure 7:
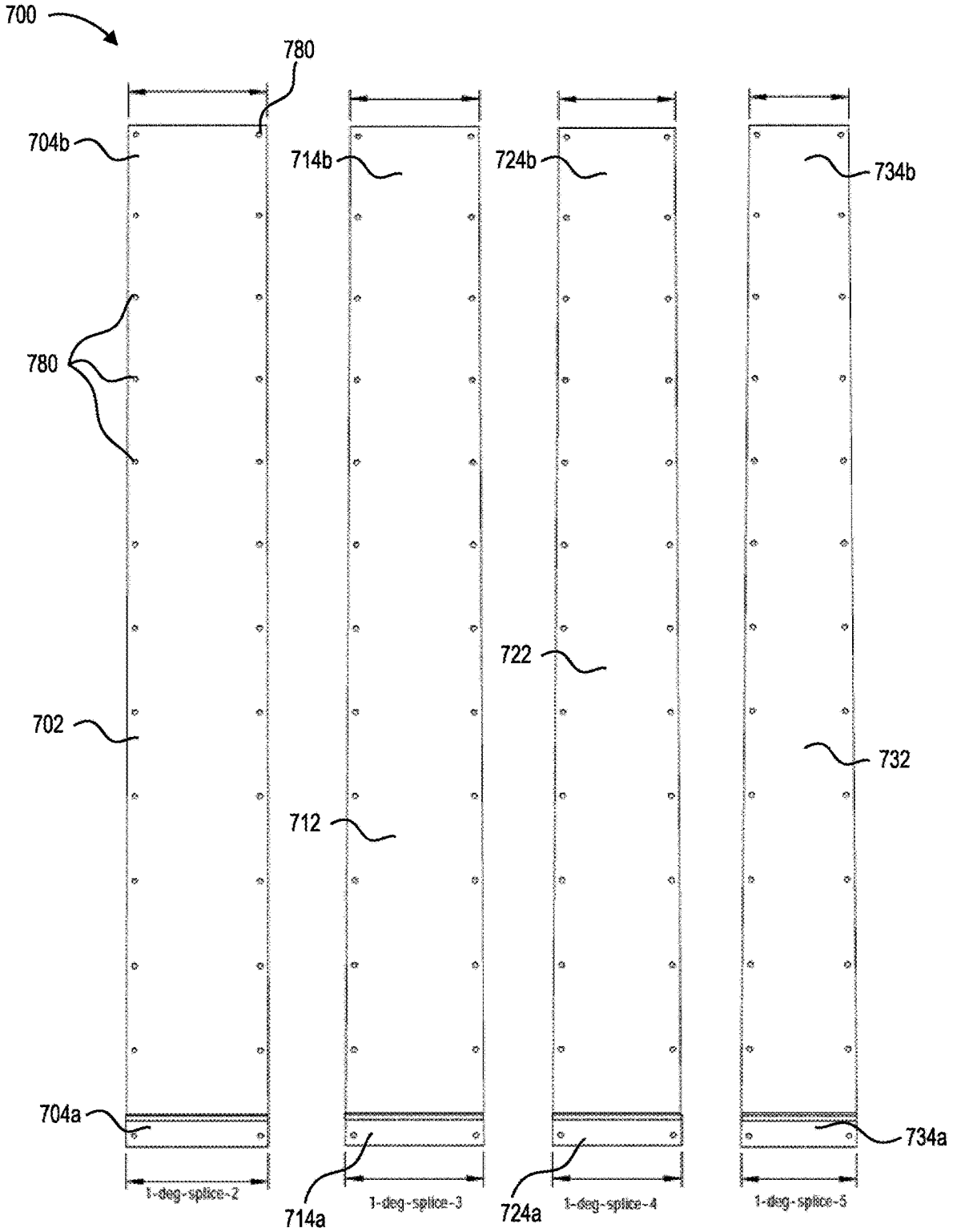
FIG. 7 illustrates a plurality of taper plates, in accordance with embodiments of the present disclosure.

To illustrate, reference is made to FIG. 7, which illustrates a plurality of taper plates 700, in accordance with embodiments of the present disclosure. The plurality of taper plates 700 may include an array having varying dimensions, such that the combination of positioned taper plates 700 may be configured as the taper member 580 (FIG. 6).

In the examples of FIG. 7, the respective taper plates 700 may be configured as wedge-shaped members. In some embodiments, the respective taper plates may be configured to have a trapezoidal shape. As an example, the first taper plate 702 may include a first plate end 704*a* having a first width and a second plate end 704*b* having a second width. In the present example, the first width may be greater than the second width.

For ease of exposition, the first plate end 704*a* may be 685 millimeters and the second plate end 704*b* may be 668 millimeters. Other plate width dimensions may be used.

A second taper plate 712 may include a first plate end 714*a* and a corresponding second plate end 714*b*, where a width of the first plate end 714*a* may be greater than the corresponding second plate end 714*b*. Solely as an illustrating example, the first plate end 714*a* of the second taper plate 712 may be 668 millimeters, and the second plate end 714*b* may be 620 millimeters.

Similarly, the third taper plate 722 and the fourth taper plate 732 may have a first plate end width greater than a corresponding second plate end width. For example, the third taper plate 722 may have a first plate end 724*a* having a width of 620 millimeters and a second plate end 724*b* having a width of 560 millimeters.

Further, the fourth taper plate 732 may have a first plate end 734*a* having a width of 560 millimeters and a second plate end 734*b* having a width of 480 millimeters.

The respective taper plates 700 may include one or more apertures 780 along a longitudinal edge or a circumferential edge. The one or more apertures 780 may be configured to lap with apertures along circumferential edges 216 (FIG. 2) of structural plates 212 (FIG. 2), and may be configured to receive fasteners (e.g., bolts). In such an example configuration, the respective taper plates 700 may secure adjacent structural plates or structural rings in non-overlapping arrangement at respective circumferential edges to form a buried structure. In some embodiments, the buried structure may extend along a non-linear path.

In some embodiments, the taper plate may be substantially rectangular in shape, and the one or more apertures may be located at various positions inward of the taper plate edges. In some scenarios, the one or more aperture positioning may be at positions inward of taper plate edges and determined based on dimensions for providing the buried structure extending a non-linear path.

In some scenarios, the one or more apertures may be configured at a location about the taper plate while an installation technician is at or near an installation site. As such, there may be efficiencies in adapting a rectangular taper plate for securing adjacent structural plates in a non-overlapping configuration along circumferential edges at an on-site installation location. Such examples of adapting a substantially rectangular-shaped taper plate may reduce the quantity of custom taper plate dimension variations to be manufactured.

The plurality of taper plates 700 illustrated in FIG. 7 may be configured to be interconnected along respective longitudinal edges. For example, the plurality of taper plates 700 may be configured such that a second end of one taper plate may be interconnected with a first end of an adjacent taper plate having a substantially similar width dimension. For illustration, the second plate end 704*b* of the first taper plate 702 (e.g., 668 millimeters) may be secured to the first plate end 714*a* of the second taper plate 704 (e.g., 668 millimeters).

By successively interconnecting taper plates 700 at longitudinal edges having substantially similar widths, the combination of the taper plates 700 provides a taper member having a successively decreasing width along the taper plate length. Thus, in some embodiments, the taper member may be configured to interconnect adjacent structural rings or structural plates to form buried structures extending along non-linear paths (see e.g., FIG. 6).

Figure 8:
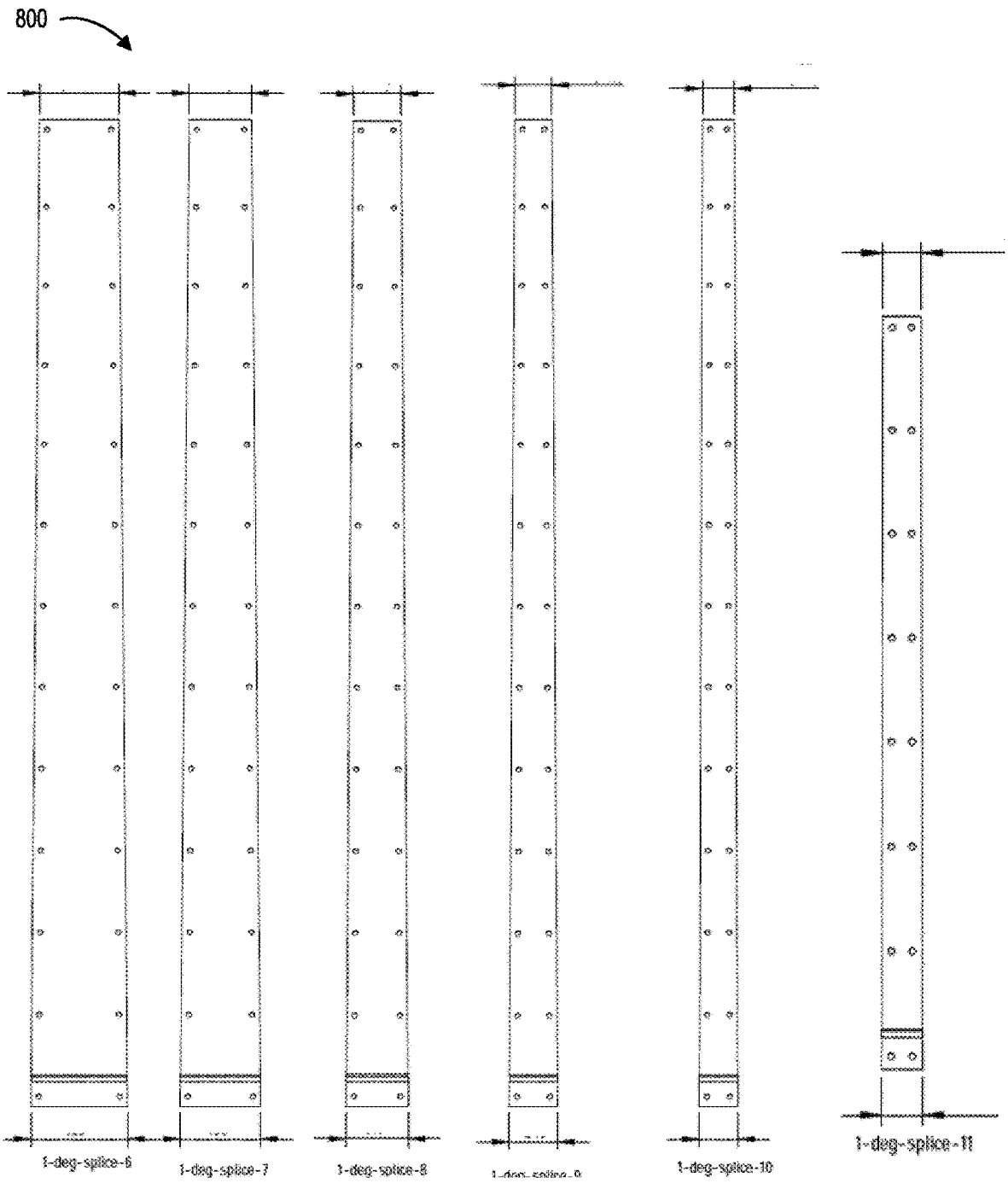
FIG. 8 illustrates a further plurality of taper plates, in accordance with embodiments of the present disclosure.

Reference is made to FIG. 8, which illustrates a further plurality of taper plates 800, in accordance with embodiments of the present disclosure. The plurality of taper plates 800 may be configured with the plurality of taper plates 700 of FIG. 7 for forming a taper member 580 (FIG. 6) for interconnecting adjacent structural rings or structural plates.

Figure 9:
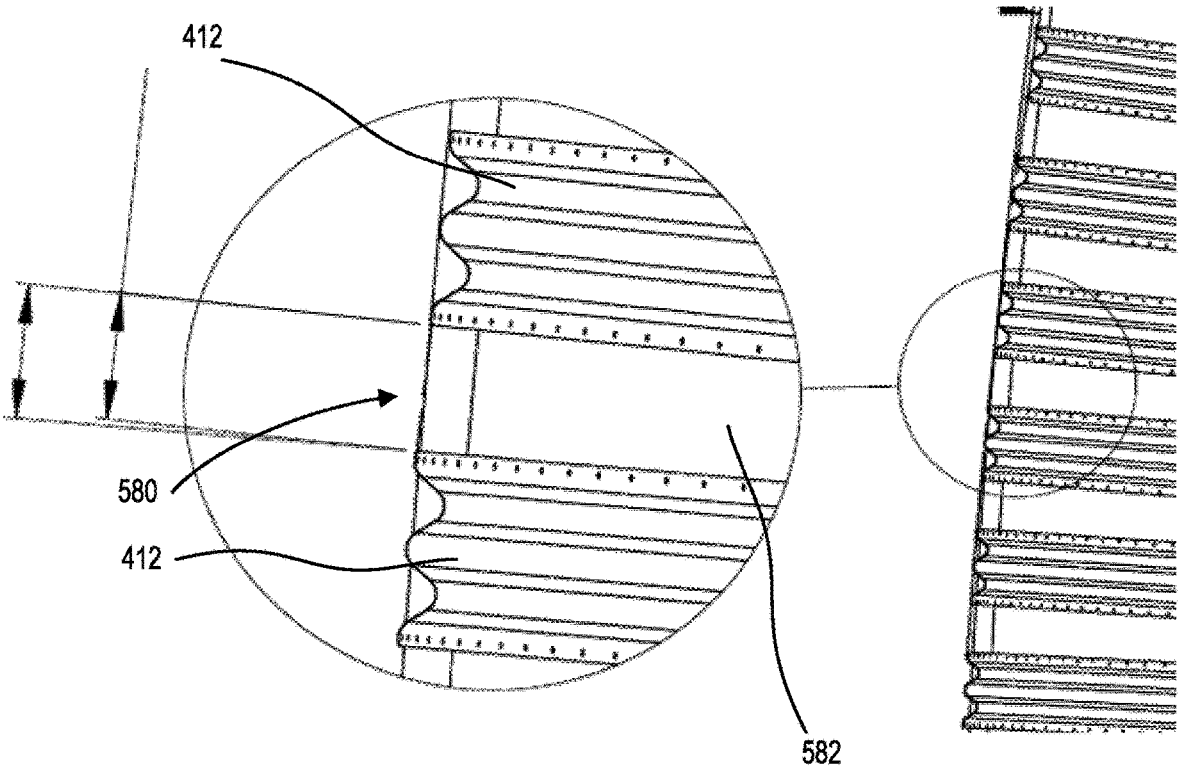
FIG. 9 illustrates an enlarged, partial view of the taper member configured to secure adjacent structural plates, in accordance with embodiments of the present disclosure.

Reference is made to FIG. 9, which illustrates an enlarged, partial view of the taper member 580 (FIG. 6) configured to secure adjacent structural plates 412 (of respective structural rings) in non-overlapping arrangement at circumferential edges, in accordance with embodiments of the present disclosure. In FIG. 9, a first taper plate 582 is illustrated.

In the illustrated example of FIG. 9, the taper member 580 may be dimensioned to secure the adjacent structural plates in non-overlapping arrangement at the circumferential edges, so as to impart a curvature of approximately 1 degree about a notional radial center point.

In some embodiments, the taper member 580, including the respective taper plates combined to form the taper member 580, may be dimensioned based on the degree of curvature required for the buried structure. In some embodiments, a plurality of taper members 580 may be dimensioned to provide approximately 1 degree of curvature as the buried structure extends along the non-linear path. As the buried structure further extends along the path, an overall curvature of the buried structure may cumulatively provide a larger overall curvature.

In FIG. 9, the taper member 580 may be positioned on an inner surface of the buried structure for interconnecting the adjacent structural plates. In some other embodiments, the taper member 580 may be positioned on an outer surface of the buried structure for interconnecting the adjacent structural plates. In some other embodiments, the taper member 580 may include a combination of taper plates on an inner surface and an outer surface of the buried structure.

Figure 10:
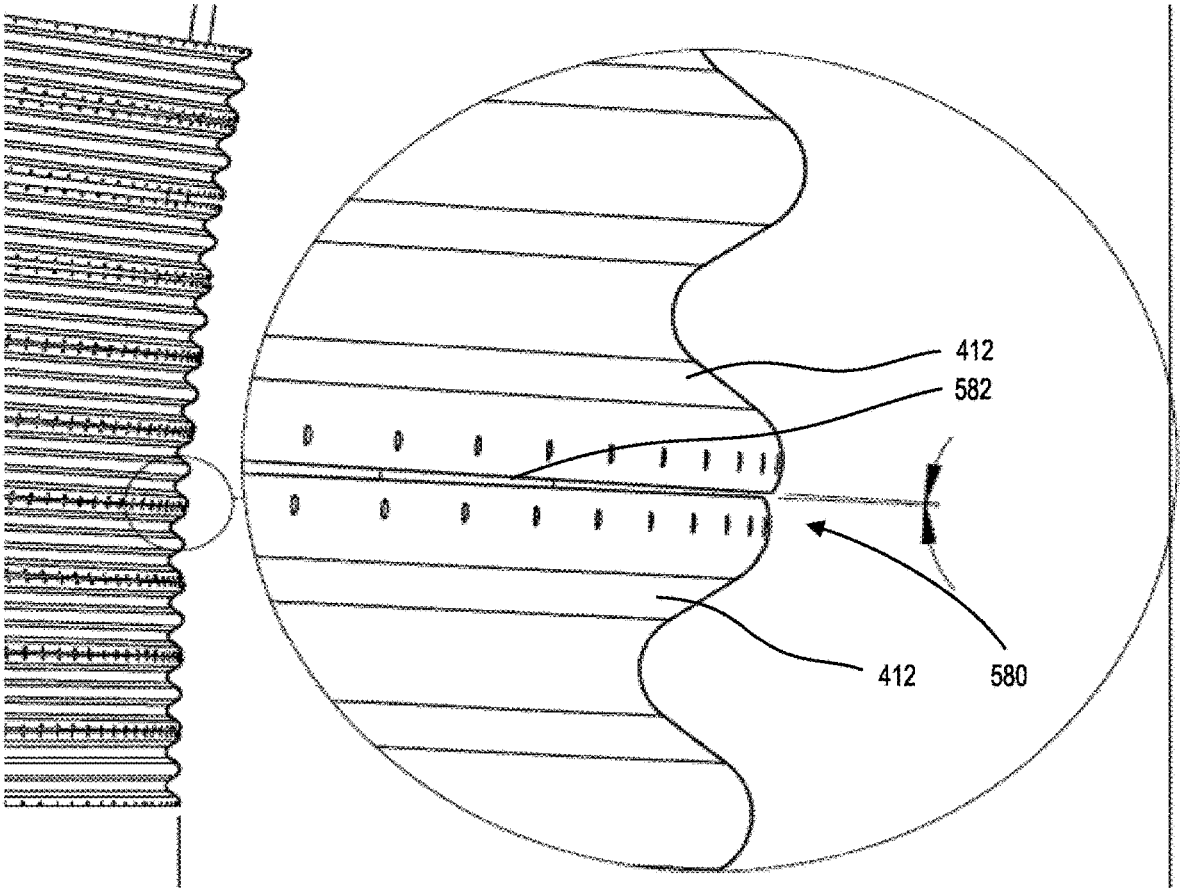
FIG. 10 illustrates an enlarged, partial view of the taper member on an opposing side of the structural ring, as compared to the partial view of FIG. 9.

Reference is made to FIG. 10, which illustrates an enlarged, partial view of the taper member 580 (FIG. 6) on an opposing side of the structural ring, as compared to the partial view illustrated in FIG. 9. In FIG. 10, the illustrated taper plate 582 may be dimensioned to have longitudinal end widths less than longitudinal end widths of taper plates 582 on an opposing side of the structural ring (e.g., shown in FIG. 9). As an example, the taper plate 582 illustrated in FIG. 10 may be dimensioned as the 10th taper plate in the above provided table of example dimensions.

In FIG. 10, the enlarged view of the taper member 580 may be proximal to a notional radial center point for referencing the degree of curvature provided to the buried structure by the taper member 580. For example, the notional radial center point may be a reference point for identifying that the taper member 580 configures a 1 degree curve among the interconnected, adjacent structural plates. In some embodiments, the taper member 580 may configure a curve among the interconnected adjacent structural plates for greater than or less than 1 degree.

Referring again to FIG. 2, buried structures may include a plurality of interconnected structural plates to provide a buried structure that follows a substantially linear path. In the illustrated example of FIG. 2, adjacent structural plates may be interconnected based on securing an overlapped portion of respective circumferential edges of adjacent structural plates.

In embodiments where the respective structural plates may have plate corrugations, circumferential edges may be secured to adjacent circumferential edges if the corrugation pattern substantially corresponds (e.g., a "peak shape" of a corrugation lining up with a "peak shape" of a corrugation on an adjacent structural plate). It may be desirable to secure adjacent corrugated plates to form a buried structure that follows a substantially linear path using embodiments of taper plate members described in the present disclosure.

In some embodiments, the taper plate members may be sized or dimensioned to have longitudinal widths based on expected load capacity that the buried structure may be designed to support. The taper plate members may be rectangular-shaped, and may be dimensioned to correspond to a distance between circumferential edges of adjacent structural plates. The distance between non-overlapping circumferential edges of adjacent structural plates may be configured as a function of the expected load capacity of the overall buried structure comprising the plurality of interconnected structural plates.

Figure 11:
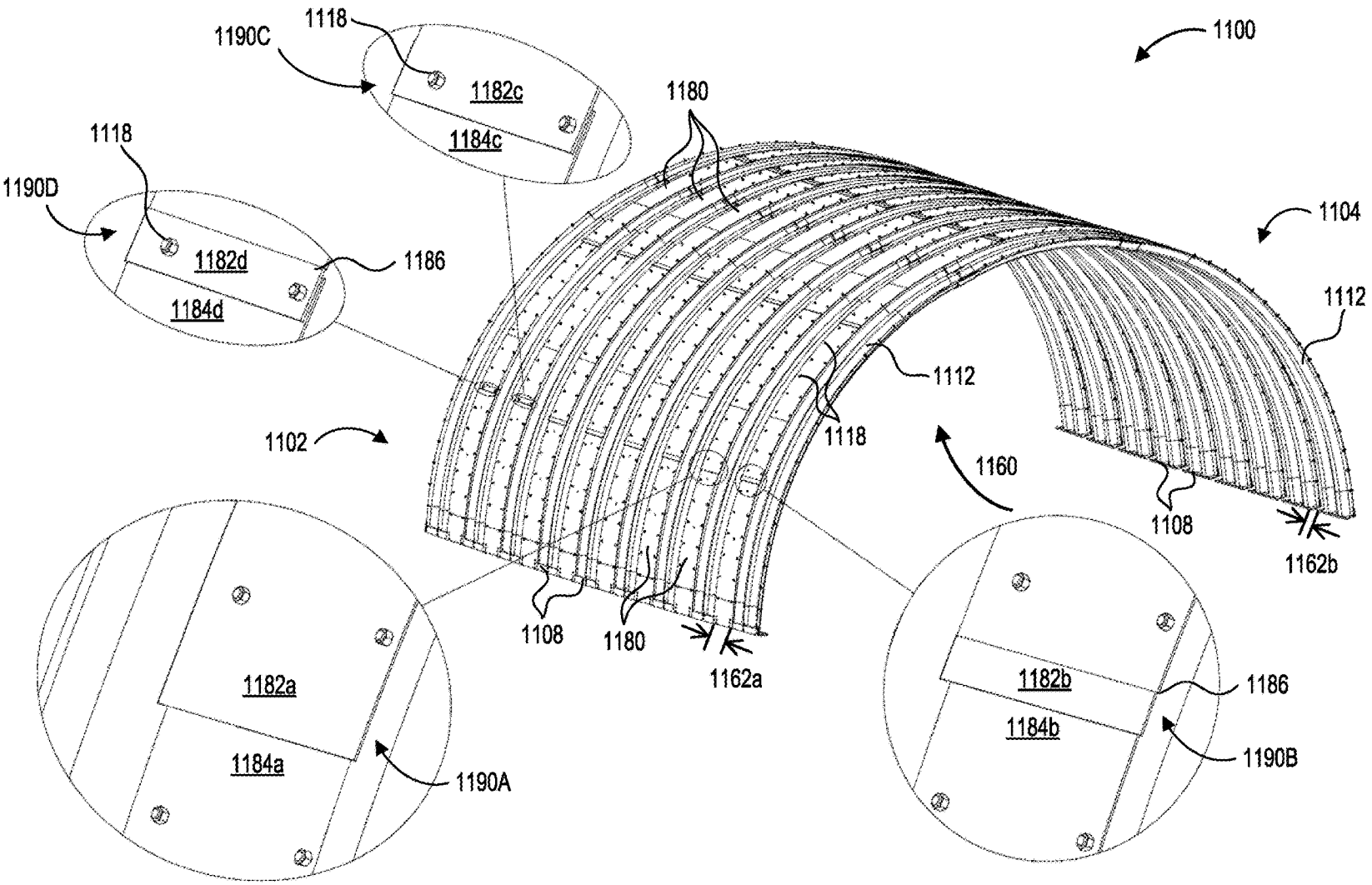
FIG. 11 illustrates a perspective view of a buried structure, in accordance with embodiments of the present disclosure.

Reference is made to FIG. 11, which illustrates a perspective view of a buried structure 1100, in accordance with embodiments of the present disclosure.

The buried structure 1100 may include a plurality of structural plates 1112 configured to form structural rings. For example, a series of structural plates 1112 may be coupled at adjoining longitudinal structural plate edges to form a structural ring. The buried structure 1100 may be constructed by interconnecting a combination of structural rings along circumferential structural plate edges.

In some embodiments, respective structural rings incorporate a termination feature 1108 to transfer loads to the foundation of the buried structure 1100.

In some embodiments, the structural plates 1112 may be corrugated. The structural plates 1112 may include corrugations configured to resist bending forces in scenarios when such structural plates 1112 are supporting a load.

Corrugation features may be defined by dimensions such as pitch, depth, or width, among other dimensions. In some scenarios, to optimally interconnect adjacent structural plates 1112 or structural rings, adjacent structural plates 1112 may need to have substantially similar corrugation features to facilitate a suitable interconnection. For example, a portion of a corrugation crest may form a circumferential structural plate edge. For such a circumferential structural plate edge to nest or mate with an adjacent circumferential structural plate edge of an adjacent structural plate, it may be necessary for the adjacent circumferential plate edge to be configured with substantially similar corrugation features (e.g., dimensions).

In some scenarios, it may be desirable to construct buried structures extending along a non-linear longitudinal path. In some examples, mitered structural plates may be configured to construct buried structures extending along a non-linear longitudinal path. In some scenarios, such mitered structural plates may be cut or constructed and welded at installation sites. In such example scenarios, it may be challenging to configure such mitered structural plates such that mating plates may have corresponding corrugation features that are aligned to nest or mate. It may be desirable to provide interconnection devices that require reduced customizations that may be necessitated by having corrugation features align to nest or mate.

The present disclosure describes embodiments of plate members for interconnecting structural plates 1112 for constructing buried structures extending in a non-linear longitudinal path 1160. In some embodiments, such plate members for interconnecting structural plates 1112 may be taper members 1180. Taper members 1180 may include a plurality of taper plates successively coupled to an adjacent taper plate along longitudinal taper edges. The successively coupled taper plates may be configured as taper member.

Referring to FIG. 11, the taper members 1180 may extend from a structural plate termination 1108 on a first side 1102 to a corresponding structural plate termination 1108 on a second side 1104 of the buried structure 1100. In some embodiments, the taper members 1180 may be configured to be a trapezoidal-shaped member for securing a combination of structural plates 1112 or structural rings along adjacent circumferential structural plate edges. Similar to the taper members 580 described with reference to FIG. 6, the taper members 1180 may be configured in the form of a trapezoid, such that successive portions of the taper member 1180 may occupy varying distance between portions of circumferential edges of structural rings.

In FIG. 11, as the taper member 1180 extends from the first side 1102 to the second side 1104 of the buried structure 1100, the taper member width may progressively decrease. As such, the distance between circumferential edges of adjacent structural rings may progressively decrease towards the second side 1104 of the buried structure.

To illustrate, in FIG. 11, a first separation distance **1162*a* between adjacent structural plate termination 1108 on the first side 1102 may be greater than a second separation distance 1162*b* between corresponding structural plate termination 1108 on the second side 1104 of the buried structure 1100. As successive structural rings are interconnected based on the taper members 1180, the buried structure 1100 is configured to extend in the non-linear longitudinal path 1160**.

The taper members 1180 may include a plurality of taper apertures 1118 positioned along circumferential taper member edges. Spacing of the taper apertures 1118 along the circumferential taper plate edges may correspond to spacing of structural plate apertures positioned along circumferential structural plate edges.

To construct the buried structure 1100, the taper members 1180 may be positioned such that the taper apertures 1118 align with structural plate apertures for receiving fasteners therein. The buried structure 1100 may be constructed by interconnecting a plurality of adjacent structural rings with the taper members 1180.

In some embodiments, taper plates may be successively positioned between circumferential structural plate edges along the structural ring. As taper apertures 1118 are aligned with structural plate apertures (e.g., apertures 218 of FIG. 2), fasteners may be received within such aligned apertures for interconnecting the adjacent structural rings.

In some embodiments, longitudinal taper plate edges of adjacent taper plates may be positioned at a first overlap interface 1190A. For example, a first longitudinal taper plate edge 1182*a* may overlap a second longitudinal taper plate edge 1184*a*.

In some embodiments, longitudinal taper plate edges of adjacent taper plates may include a transition feature 1186 at a second overlap interface 1190B. The transition feature 1186 may be a raised or recessed edge, and may be positioned proximal to a first longitudinal taper plate edge 1182*b*. In the present example, the adjacent taper plates may be positioned such that a second longitudinal taper plate edge 1184*b* may be nested about the transition feature 1186 of the first longitudinal taper plate edge 1182*b*.

In embodiments having the first overlap interface 1190A or the second overlap interface 1190B, the adjacently positioned taper plates include longitudinal taper edges that may be uncoupled from adjacent longitudinal taper edges, thereby substantially reducing transferring thrust forces between taper plates and towards buried structure plate termination 1108. In embodiments, longitudinal taper edges that are uncoupled from adjacent longitudinal taper edges may be unbolted or otherwise not fastened at the overlap interface.

In the above described embodiments, a combination of: (a) longitudinal taper plate edges being uncoupled from adjacent longitudinal taper plate edges to substantially reduce transferring thrust forces between taper plates; and (b) circumferential taper edges being coupled to circumferential structural plate edges may result in: thrust forces (among other types of forces) incident at the taper plates being transferred or coupled via the fastened interconnection along circumferential plate edges to the corrugated structural plates 1112.

In the above described embodiments, the plurality of taper plates may be configured as having a lower thickness dimension than otherwise would be required in scenarios where adjacent taper plates are coupled and configured for transferring thrust forces towards corresponding structural plate termination 1108.

In some embodiments, longitudinal taper plate edges of adjacent taper plates may be positioned at a third overlap interface 1190C. In FIG. 11, the third overlap interface 1190C may be proximal to a position where taper apertures 1118 align with structural plate apertures. Such structural plate apertures may be apertures positioned along a circumferential edge of the structural plate 1112 ("circumferential structural plate edge"). For example, a first longitudinal taper plate edge 1182*c* proximal a taper aperture 1118 may overlap a second longitudinal taper plate edge 1184*c*. At positions where taper apertures 1118 align with structural plate apertures, fasteners may be received therein for interconnecting the adjacent circumferential structural plate edges.

In some embodiments, longitudinal taper plate edges of adjacent taper plates may include a transition feature 1186 at a fourth overlap interface 1190D. The transition feature 1186 may be a raised or recessed edge, and may be positioned proximal to a first longitudinal taper plate edge 1182*d*. In the present example, the adjacent taper plates may be positioned such that a second longitudinal taper plate edge 1184*d* may be nested about the transition feature 1186 of the first longitudinal taper plate edge 1182*d*.

In FIG. 11, the fourth overlap interface 1190D may be proximal to a position where taper apertures 1118 align with circumferential structural plate apertures. For example, a first longitudinal taper plate edge 1182*d* proximal a taper aperture 1118 may overlap a second longitudinal taper plate edge 1184*d*. At positions where taper apertures 1118 align with structural plate apertures, fasteners may be received therein for interconnecting the adjacent circumferential structural plate edges.

Embodiments of the overlap interfaces (1190C, 1190D) may be proximal to a position where taper apertures 1118 align with structural plate apertures. Fasteners may be inserted into aligned taper apertures 1118 and structural plate apertures.

Although the alignment of taper apertures with circumferential structural plate apertures at the third overlap interface 1190C or the fourth overlap interface 1190D may in effect couple adjacent taper plates at longitudinal taper edges, in some scenarios, the quantity of aligned and overlapping taper apertures 1118 and circumferential structural plate apertures may be greater than the quantity of overlapping apertures at the longitudinal taper edge interfaces.

Accordingly, thrust forces (among other types of forces) incident at the taper plates may be substantially transferred or coupled via the fastened interconnection along circumferential structural plate edges to the corrugated structural plates 1112. In the present examples, the quantity of thrust force that may be transferred from taper plate to taper plate may be substantially reduced.

Based on embodiments described herein, the plurality of taper plates may be configured with a lower plate thickness dimension than a structural plate thickness dimension of the adjacent structural plates. Additionally, the plurality of taper plates may have a lower plate thickness dimension than otherwise would be required in scenarios where thrust forces are predominantly transferred between taper plates towards the structure plate terminations 1108.

FIG. 11 illustrates the buried structure 1100 including a plurality of overlap interface types, such as overlap interfaces having a transition feature 1186 or overlap interfaces without the transition feature 1186. FIG. 11 also illustrates overlap interfaces proximal to a position where taper apertures 1118 may align with structural plate apertures. In some embodiments, the buried structure 1100 may be configured with a single type of overlap interface type, or may be configured with a combination of two or more overlap interface types.

Figure 12:
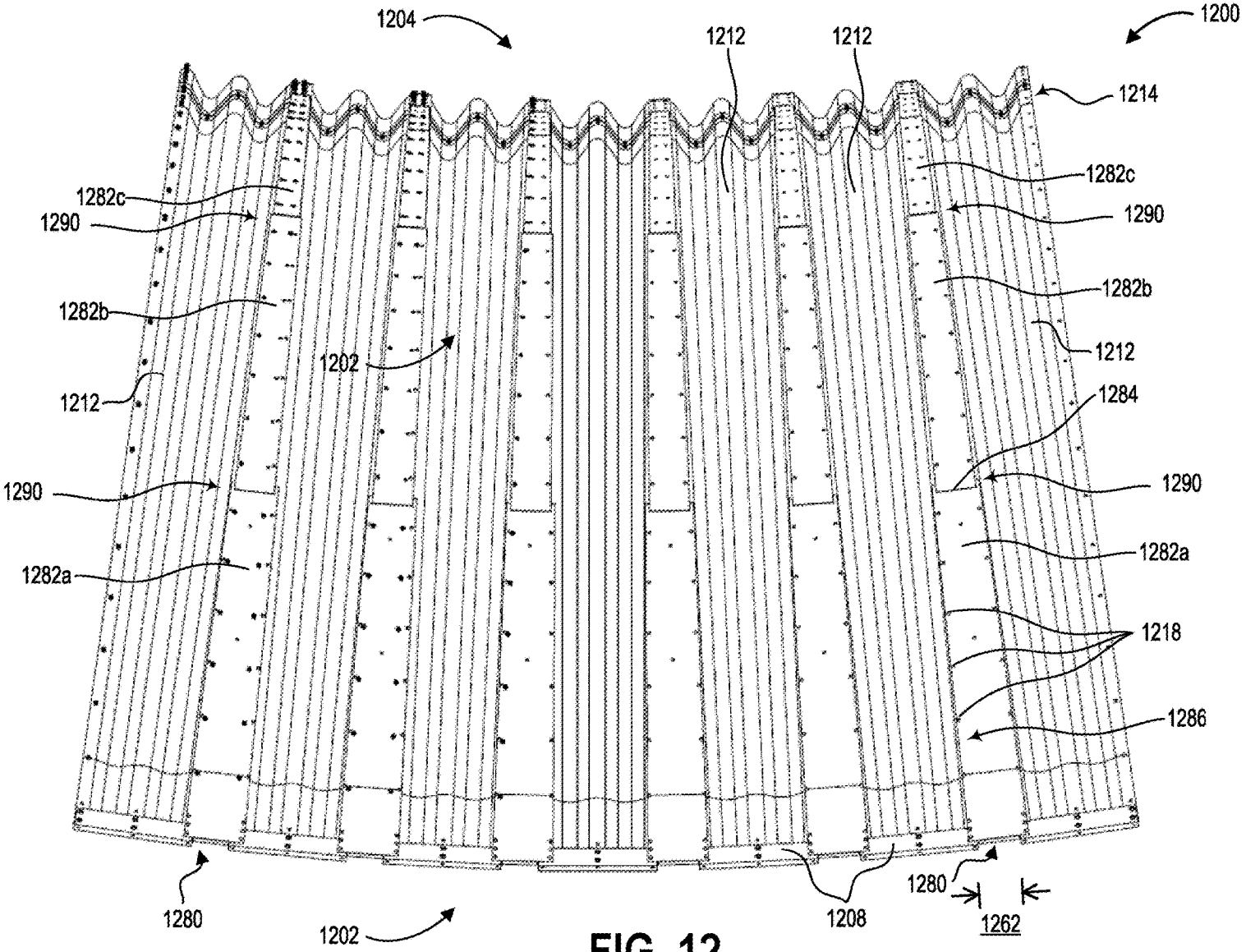
FIG. 12 illustrates a side elevation view of a buried structure, in accordance with embodiments of the present disclosure.

Reference is made to FIG. 12, which illustrates a side elevation view of a buried structure 1200, in accordance with embodiments of the present disclosure. In FIG. 12, the buried structure 1200 may include taper members 1280 configured for interconnecting adjacent structural plates 1212.

In some embodiments, a plurality of structural plates 1212 may be assembled as a structural plate ring. For example, respective structural plates 1212 may be coupled to an adjacent structural plate 1212 along a longitudinal structural plate edge 1214. In the side elevation view of FIG. 12, a single structural plate 1212 is illustrated, and adjacent structural plates 1212 coupled at longitudinal structural plate edges 1214 are shown to be oriented into the drawing page.

In some embodiments, the plurality of structural plates 1212 may be corrugated. The corrugation features may be defined by dimensions such as pitch, depth, or width, among other dimensions.

In some embodiments, the taper members 1280 may be a combination of taper plates positioned adjacent to other taper plates along a longitudinal taper plate edge 1284. The taper plates may be configured as trapezoidal-shaped plates. A set of taper plates may include taper plates having successively decreasing longitudinal taper plate edge widths.

For example, a first taper plate 1282*a* may be configured as a trapezoidal-shaped plate and have different longitudinal taper plate edge widths. A second taper plate 1282*b* may be configured as a trapezoidal-shaped plate having progressively smaller longitudinal taper plate edge width dimensions. Further, a third taper plate 1282*c* may be configured as a trapezoidal-shaped plate having further progressively smaller longitudinal taper plate edge width dimensions. In some embodiments, additional taper plates not explicitly illustrated in FIG. 12 may: (i) have further progressively smaller longitudinal taper plate edge width dimensions; or (ii) have progressively larger longitudinal taper plate edge width dimensions towards a foundation on an opposing side of the structure.

For the illustrated taper plates in FIG. 12, a separation distance 1262 between adjacent circumferential structural plate edges will progressively decrease (and in some embodiments progressively increase) as the taper member 1280 extends from structural plate terminations 1208 on a first side 1202 to structural plate terminations (not explicitly illustrated in FIG. 12) on a second side 1204 of the buried structure 1200. As the successive structural rings are interconnected based on the taper members 1280, the buried structure 1200 is configured to extend in a non-linear longitudinal path.

The taper members 1280 may include a plurality of taper apertures 1218 positioned along circumferential taper member edges 1286. Spacing of the taper apertures 1218 along the circumferential taper member edges 1286 may substantially correspond to spacing of structural plate apertures positioned along circumferential structural plate edges. In FIG. 12, the taper members 1280 are laid atop the circumferential structural plate edges (e.g., on an outer surface of the buried structure 1200); however, in some other embodiments, the taper members 1280 may be positioned on an inner side of the buried structure, and along circumferential structural plate edges.

Adjacent taper plates (1282*a*/1282*b* or 1282*b*/1282*c*) may be positioned such that longitudinal taper plate edges 1284 form an overlap interface 1290. In FIG. 12, the respective taper plate overlap interfaces 1290 may be similar to the first overlap interface 1190A described with reference to FIG. 11. For example, the adjacently positioned longitudinal taper plate edges 1284 may be uncoupled from adjacent longitudinal taper plate edges 1284, thereby substantially reducing transfer of thrust forces between taper plates (1282*a*, 1282*b*, 1282*c*). In some embodiments, longitudinal taper plate edges 1284 that are uncoupled from adjacent longitudinal taper plate edges 1284 may be configured as an overlap interface 1290 where the longitudinal taper plate edges are unfastened or unbolted.

In FIG. 12, the longitudinal taper plate edges 1284 at the respective taper plate overlaps 1290 are uncoupled or unbolted. Accordingly, the uncoupled configuration at the overlap interfaces 1290 may substantially reduce thrust force transfer between taper plates. Further, thrust forces (among other types of forces) incident at the taper plates may be transferred or coupled via the fastened interconnections at the circumferential taper plate edges 1286 and the circumferential structural plate edges. In FIG. 12, the circumferential structural plate edges are not explicitly shown, and are illustrated to have been overlapped by the circumferential taper plate edges 1286.

In some embodiments, the taper members 1280 include a combination of taper plates (1282*a*, 1282*b*, 1282*c*). The taper members 1280 may be substantially un-corrugated. For example, the taper plates may be configured as substantially planar with a radius to correspond with a radius of the structural plates 1212. In some embodiments, the taper members 1280 may be configured as a curvilinear surface.

As the taper members 1280 may be un-corrugated in some embodiments, ensuring that the physical dimensions of the circumferential structural plate edge may nest or otherwise interface with the taper members 1280 may not be as design onerous as compared to if the taper members 1280 included corrugation features. That is, if taper members 1280 included corrugation features, corrugation feature dimensions that do not substantially match may result in structural plate edges that do not nest or otherwise interface flush with the circumferential taper member edges 1286.

Further, as the uncoupled configuration at the taper plate overlap interfaces 1290 substantially reduces thrust force transfer between taper plates, the taper plates (1282*a*, 1282*b*, 1282*c*) may have a plate thickness dimension that is smaller than if the taper plates were to transfer thrust forces successively from taper plate-to-taper plate towards a foundation. As described, because circumferential taper edges 1286 are coupled to circumferential structural plate edges via fasteners, thrust forces (among other types of forces) incident at the taper plates may be transferred or coupled via the fastened interconnection to the corrugated structural plates 1212. Embodiments of the taper members 1280 including an uncoupled, overlap interface at longitudinal taper plate edges thereby reduces plate configuration complexity required for constructing buried structures 1200 extending in a non-linear, longitudinal path.

In the example buried structure 1200 illustrated in FIG. 12, thrust forces at the taper plates/taper members 1280 may be transferred to the adjoining structural plates 1212, and the structural plates 1212 (forming the structural rings) may transfer the thrust forces towards the respective structural plate termination 1208. In the present example, the taper members 1280 may not need to have a plate thickness that otherwise would be required to bear or transfer thrust forces to respective structural plate termination 1208.

In various embodiments described in the present disclosure, taper members 1280 may be configured to: (1) interconnect structural plates 1212 configured as structural rings; and (2) progressively alter the distance between adjacent circumferential structural plate edges as the taper members 1280 extend from one or more structural plate terminations 1208 on a first side 1202 to one or more structural plate terminations 1208 on a second side 1204 of the buried structure 1200. By altering longitudinal taper plate width dimensions progressively over a circumferential length of taper members 1280, buried structures may be constructed to extend in non-linear, longitudinal directions.

Figure 13:
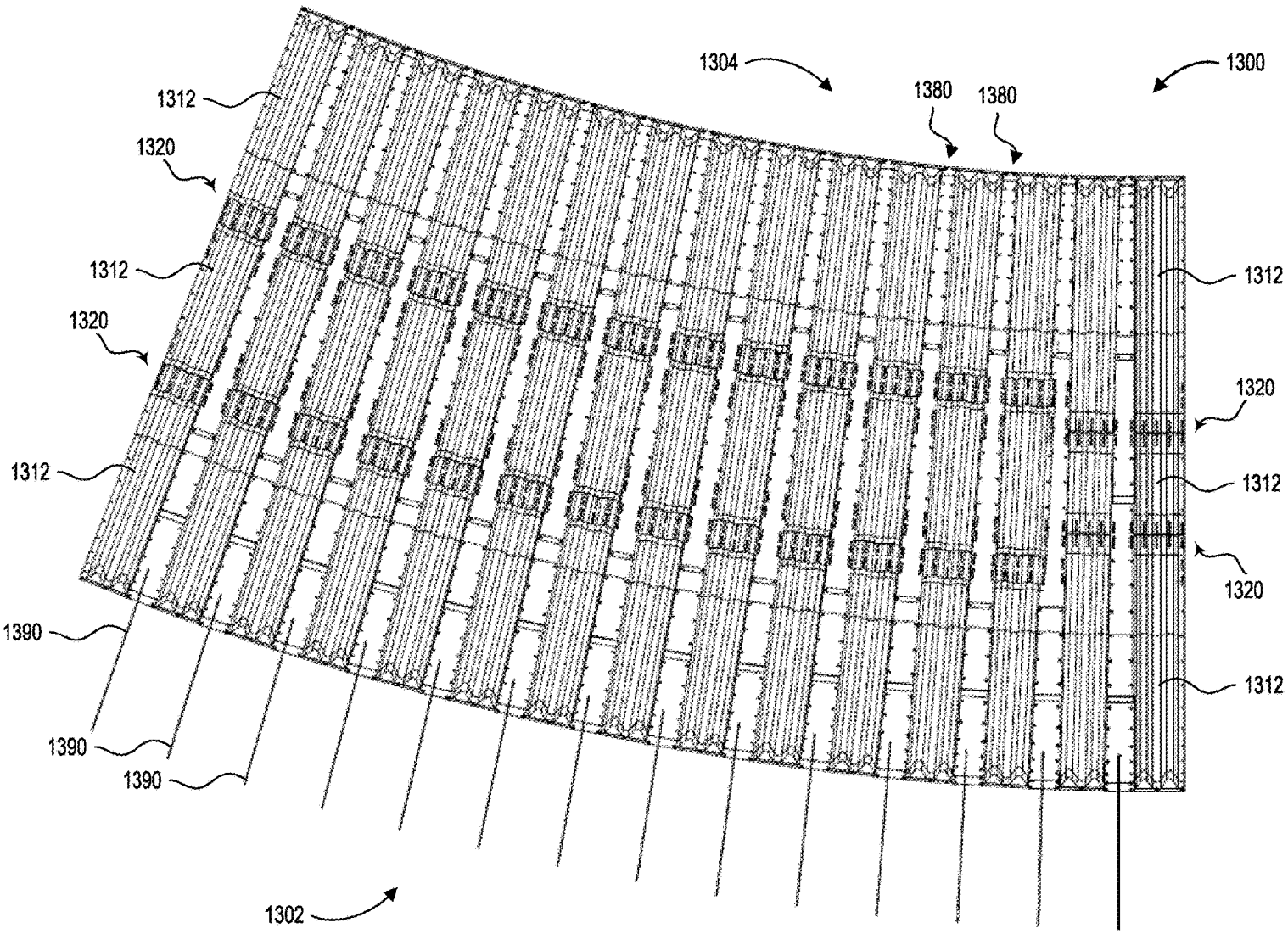
FIG. 13 illustrates a top plan view of a buried structure, in accordance with embodiments of the present disclosure.

Reference is made to FIG. 13, which illustrates a top plan view of a buried structure 1300, in accordance with embodiments of the present disclosure. The buried structure 1300 may be constructed from a plurality of structural plates 1312 coupled at longitudinal structural plate edges. The plurality of coupled structural plates 1312 may provide structural rings extending from one or more structural plate terminations on a first side 1302 to a second side 1304 of the buried structure 1300. The plurality of structural plates 1312 may be coupled at adjacent longitudinal structural plate edges based on embodiments of joiner plates 1320.

Embodiments of joiner plates 1320 may be plate segments having corrugation features that substantially correspond to corrugation features of the respective structural plates 1312, such that joiner plates may be nested with the structural plates 1312 at the longitudinal structural plate edges. Embodiments of joiner plates 1320 may include features described in PCT patent application publication number PCT/CA2020/051404, the entirety of which is incorporated by reference herein.

The buried structure 1300 includes a plurality of taper members 1380 interconnecting adjacent pairs of structural rings. As described in the present disclosure, the taper members 1380 may be a combination of trapezoidal-shaped taper plates. The respective trapezoidal-shaped taper plates may have progressively smaller longitudinal taper plate edge width dimensions in traversing from one longitudinal taper plate edge to another longitudinal taper plate edge, such that a separation distance between circumferential structural ring edges may progressively change as the taper plate extends along the circumferential structural ring edge.

In some embodiments, the buried structure 1300 may be configured with one or more tie-back members 1390. The tie-back members 1390 may be geo-structural members coupled to one or more taper members 1380 and for imparting force away from the buried structure 1300. As such, the tie-back members 1390 may be configured to reduce at least one of thrust forces, bending forces, or shear forces incident at the one or more taper members 1380 or the structural plates 1312 under load.

Figure 14:
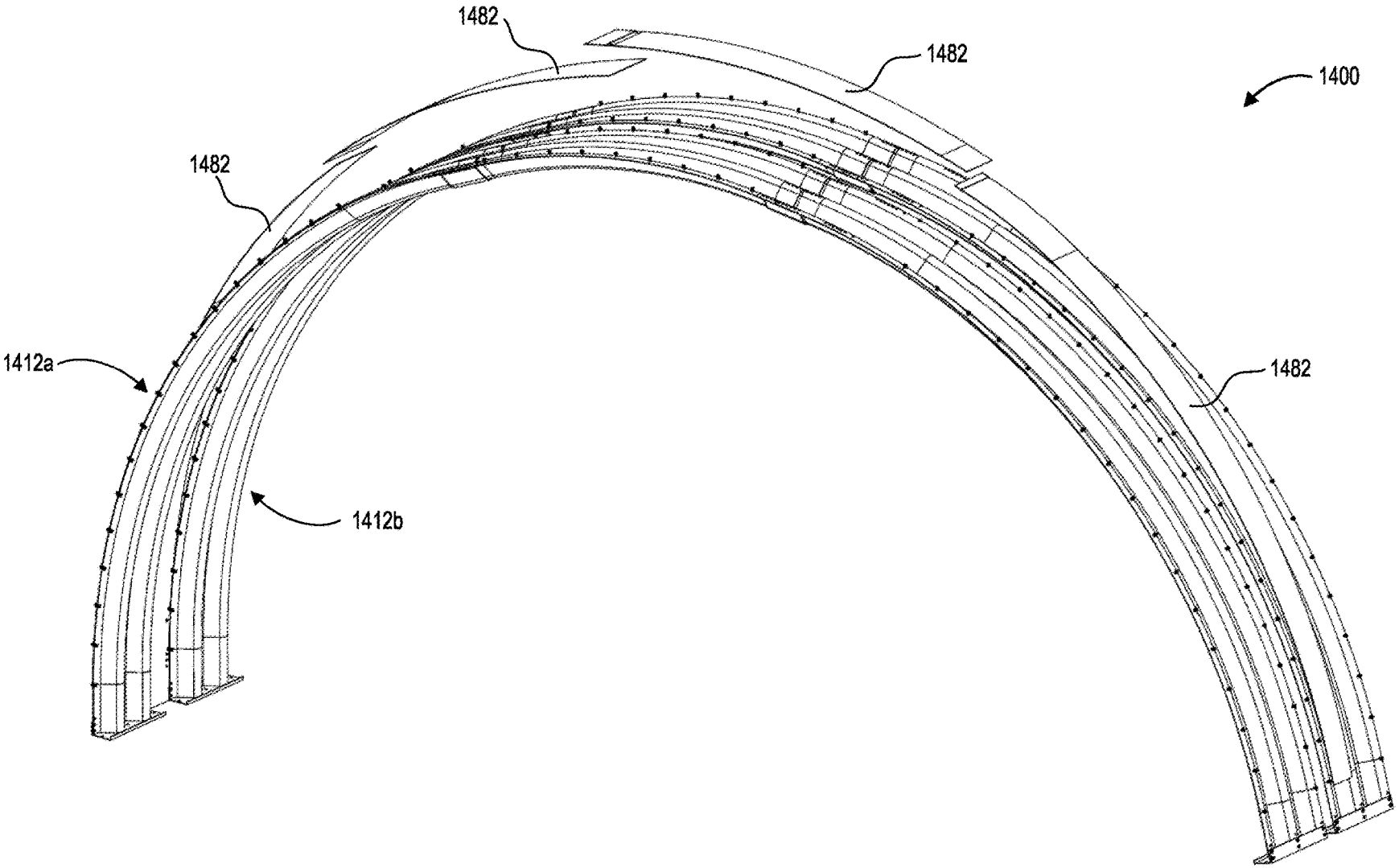
FIG. 14 illustrates a partial, exploded view of a buried structure, in accordance with embodiments of the present disclosure.

Reference is made to FIG. 14, which illustrates a partial, exploded view of a buried structure 1400, in accordance with embodiments of the present disclosure.

FIG. 14 illustrates a first structural ring 1412*a* positioned adjacent a second structural ring 1412*b*. The respective first structural ring 1412*a* and the second structural ring 1412*b* may include a series of structural plates coupled at longitudinal structural plate edges. The structural plates may be corrugated plates described in embodiments of the present disclosure.

The buried structure 1400 may include a plurality of taper plates 1482. The taper plates 1482 may include features of embodiments of the taper plates described in the present disclosure.

The buried structure 1400 may be constructed by assembling a series of structural plates into structural rings, such as the first structural ring 1412*a* and the second structural ring 1412*b*. The structural rings may be positioned adjacent to other structural rings and positioned upright at an installation site. One or more taper plates 1482 may subsequently be overlaid on circumferential structural plate edges of the structural rings, and taper apertures (described in embodiments of the present disclosure) may be aligned with structural plate apertures (described in embodiments of the present disclosure). Fasteners may be received within aligned taper apertures and corresponding structural plate apertures. Successive interconnection of structural rings with configured taper plates may provide the buried structure 1400.

Figure 15:
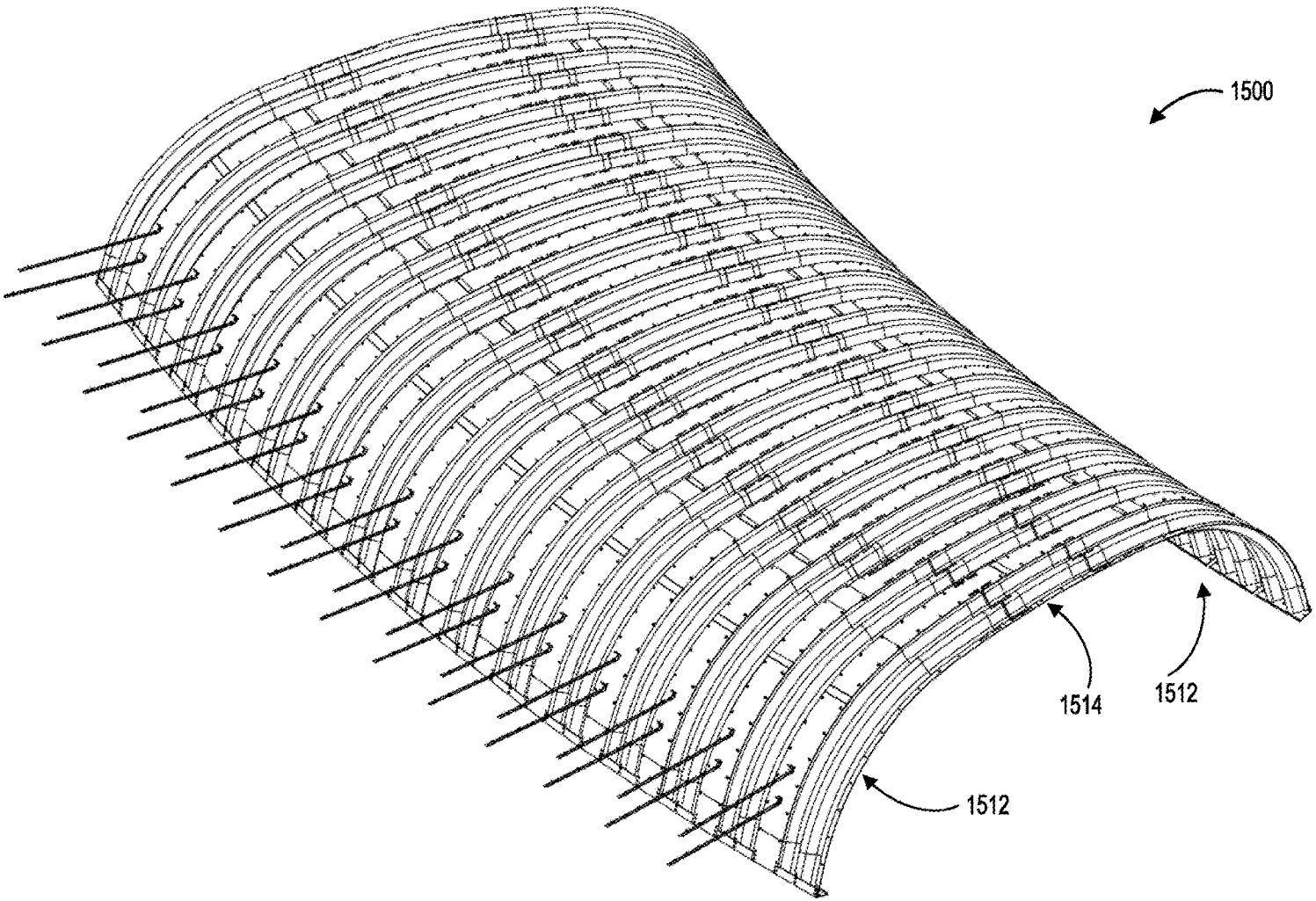
FIG. 15 illustrates a perspective view of a buried structure, in accordance with embodiments of the present disclosure.

Reference is made to FIG. 15, which illustrates a perspective view of a buried structure 1500, in accordance with embodiments of the present disclosure.

The buried structure 1500 may be a box-shaped structure having structural rings assembled with structural plates having at least two different radius dimensions. For example, the series of structural plates assembled to extend from structural plate termination on a first side to structural plate termination on a second side of the buried structure 1500 may have markedly different radius dimensions. For example, first structural plates 1512 proximal to the respective structural plate termination may have a radius dimension that is smaller than a radius dimension of second structural plates 1514 distal to the respective structural plate terminations. In some embodiments, the structural plates distal to the respective structural plate terminations may be proximal to the structure crown.

In contrast, the buried structure 1100 described with reference to FIG. 11 includes structural rings assembled with structural plates having substantially similar radius dimensions from structural plate terminations 1108 on the first side 1102 to structural terminations 1108 on the second side 1104 of the buried structure 1100.

Some embodiments of the present disclosure describe buried structures constructed to extend in a non-linear, longitudinal direction. For example, taper plates configured to interconnect adjacent structural rings such that a separation distance between adjacent circumferential structural ring edges may progressively vary as the taper plates extend from structural plate termination on one side of a buried structure to structural plate termination on an opposing side of a buried structure. For example, the separation distance that progressively increases or decreases as a series of taper plates extend from structural plate termination on one side to structural plate termination on another side of the buried structure. Such examples provide buried structures that may extend in a non-linear direction across a horizontal plane.

It may be desirable to configure buried structures to extend in a non-linear direction in a plane perpendicular to the horizontal plane (e.g., vertical plane), or a plane that is any amount of elevation from a given horizontal plane. For example, the buried structure may be configured to extend in a non-horizontal plane. To illustrate, reference is made to FIG. 16, which illustrates a perspective view of a buried structure 1600, in accordance with embodiments of the present disclosure.

The buried structure 1600 includes a plurality of structural rings 1612, where the respective structural rings 1612 may include a plurality of structural plates coupled to adjacent structural plates at longitudinal plate edges. The respective structural rings 1612 may extend from a structural plate termination 1608 on one side of the buried structure 1600 to a corresponding structural plate termination 1608 on a second side of the buried structure 1600.

Figure 16:
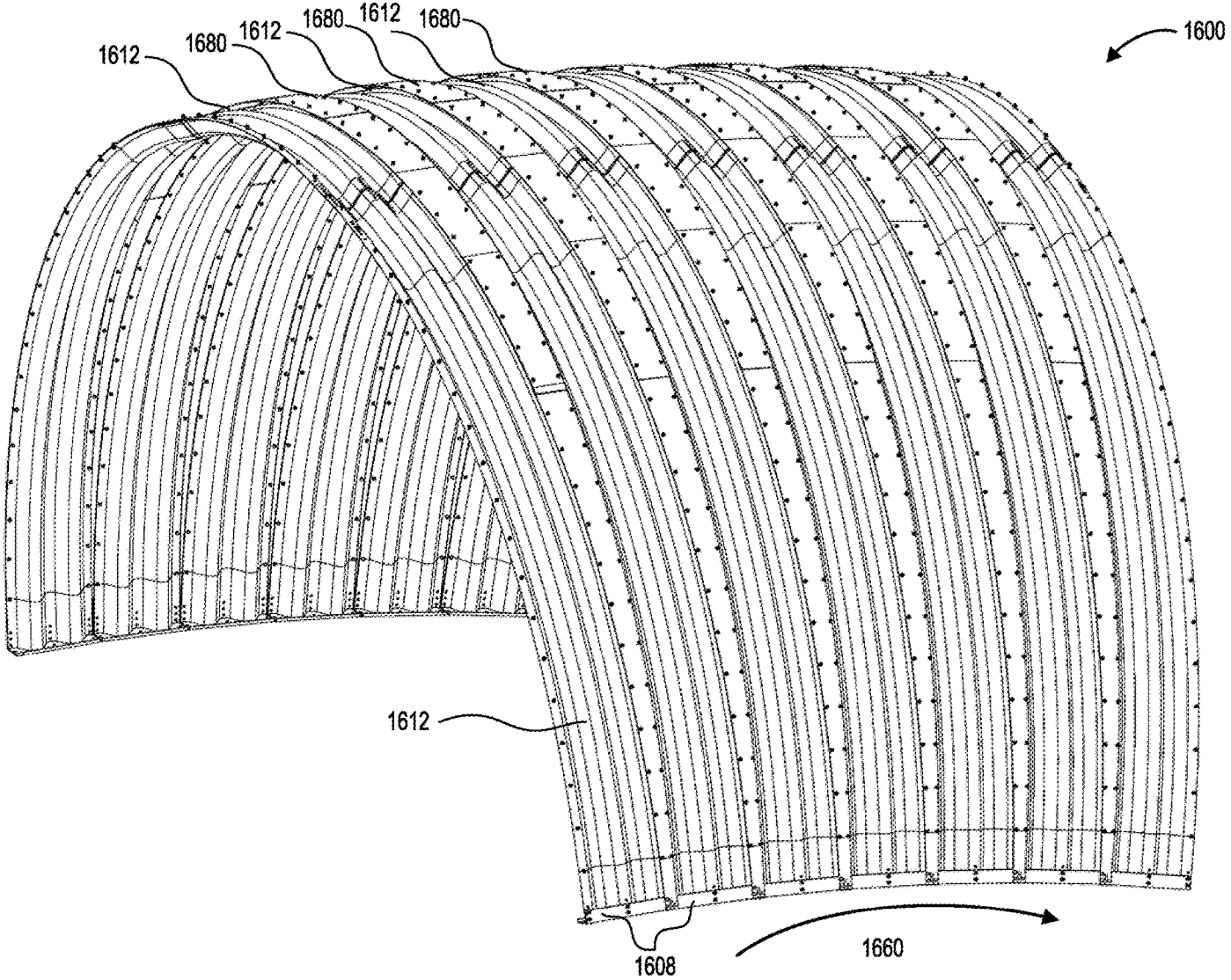
FIG. 16 illustrates a perspective view of a buried structure, in accordance with embodiments of the present disclosure.

In FIG. 16, respective structural rings 1612 may be interconnected with an adjacent structural ring by a taper member 1680. The taper member 1680 may include a plurality of taper plates positioned to overlap at longitudinal taper plate edges.

In FIG. 16, the buried structure 1600 is configured to extend in a non-linear, longitudinal direction 1660 in a non-horizontal plane. For example, the buried structure 1600 may be configured to follow a change or altering grade. For example, if the buried structure 1600 of FIG. 16 begins at a top of a hill, the buried structure 1600 may extend into a descending grade. In another example, if the buried structure 1600 of FIG. 16 begins at a bottom of a hill, the buried structure 1600 may extend into an ascending grade.

In the embodiment illustrated in FIG. 16, the taper member 1680 may interconnect adjacent structural rings 1612 such that adjacent circumferential structural ring edges proximal to structural plate terminations 1608 may have a separation distance that is smaller than a separation distance of adjacent circumferential structural ring edges distal from the structural plate terminations 1608 (e.g., proximal to the structure crown).

Figure 17:
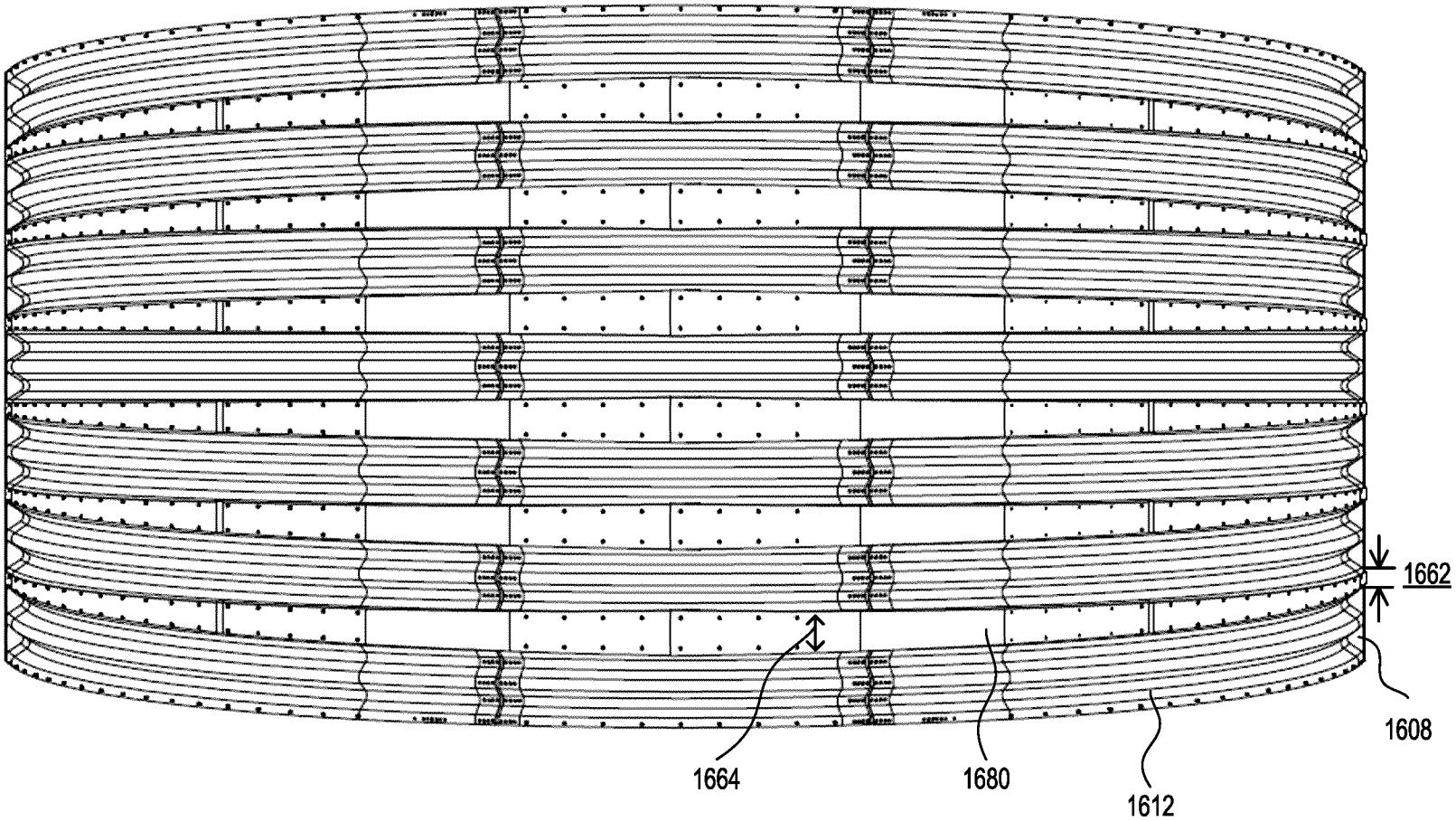
FIG. 17 illustrates a top plan view of the buried structure of FIG. 16.

To illustrate, reference is made to FIG. 17, which illustrates a top plan view of the buried structure 1600 of FIG. 16. In FIG. 17, the separation distance 1662 (proximal to the structural plate terminations 1608) between circumferential structural ring edges of adjacent structural rings is less than the separation distance 1664 between circumferential structural ring edges of adjacent structural edges distal (e.g., near the structure crown) from the structural plate terminations 1608. The illustrated buried structure 1600 may be configured to extend to follow changing or altered grade.

Figure 18:
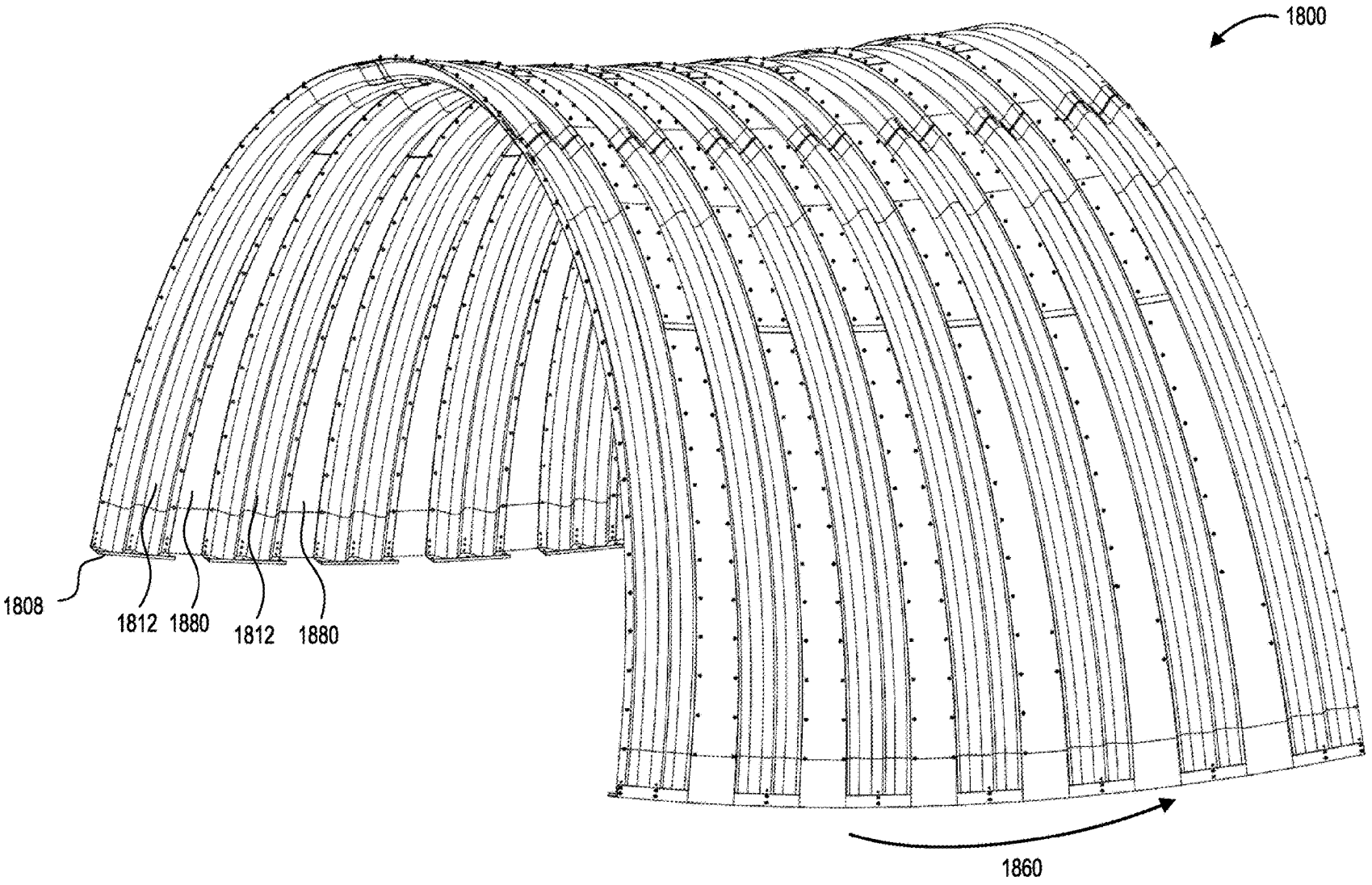
FIG. 18 illustrates a perspective view of a buried structure, in accordance with embodiments of the present disclosure.

Reference is made to FIG. 18, which illustrates a perspective view of a buried structure 1800, in accordance with embodiments of the present disclosure.

The buried structure 1800 includes a plurality of structural rings 1812, where the respective structural rings 1812 may include a plurality of structural plates coupled to adjacent structural plates at longitudinal plate edges. The respective structural rings 1812 may extend from a structural plate termination 1808 on one side of the buried structure to a corresponding structural plate termination 1808 on a second side of the buried structure 1800.

In FIG. 18, respective structural rings 1812 are interconnected with an adjacent structural ring by a taper member 1880. The taper member 1880 may include a plurality of taper plates positioned to overlap at longitudinal taper plate edges.

In FIG. 18, the buried structure 1800 is configured to extend in a non-linear, longitudinal direction 1860 in a non-horizontal plane. For example, the buried structure 1800 may be configured to follow a changing or altering grade (e.g., up a hill or down a hill, depending on the starting point of the buried structure).

In the embodiment illustrated in FIG. 18, the taper member 1880 may interconnect adjacent structural rings 1812 such that adjacent circumferential structural ring edges proximal to the structural plate terminations 1808 may have a separation distance that is larger than a separation distance of adjacent circumferential structural ring edges distal from the structural plate terminations 1808 (e.g., proximal to the structure crown).

Figure 19:
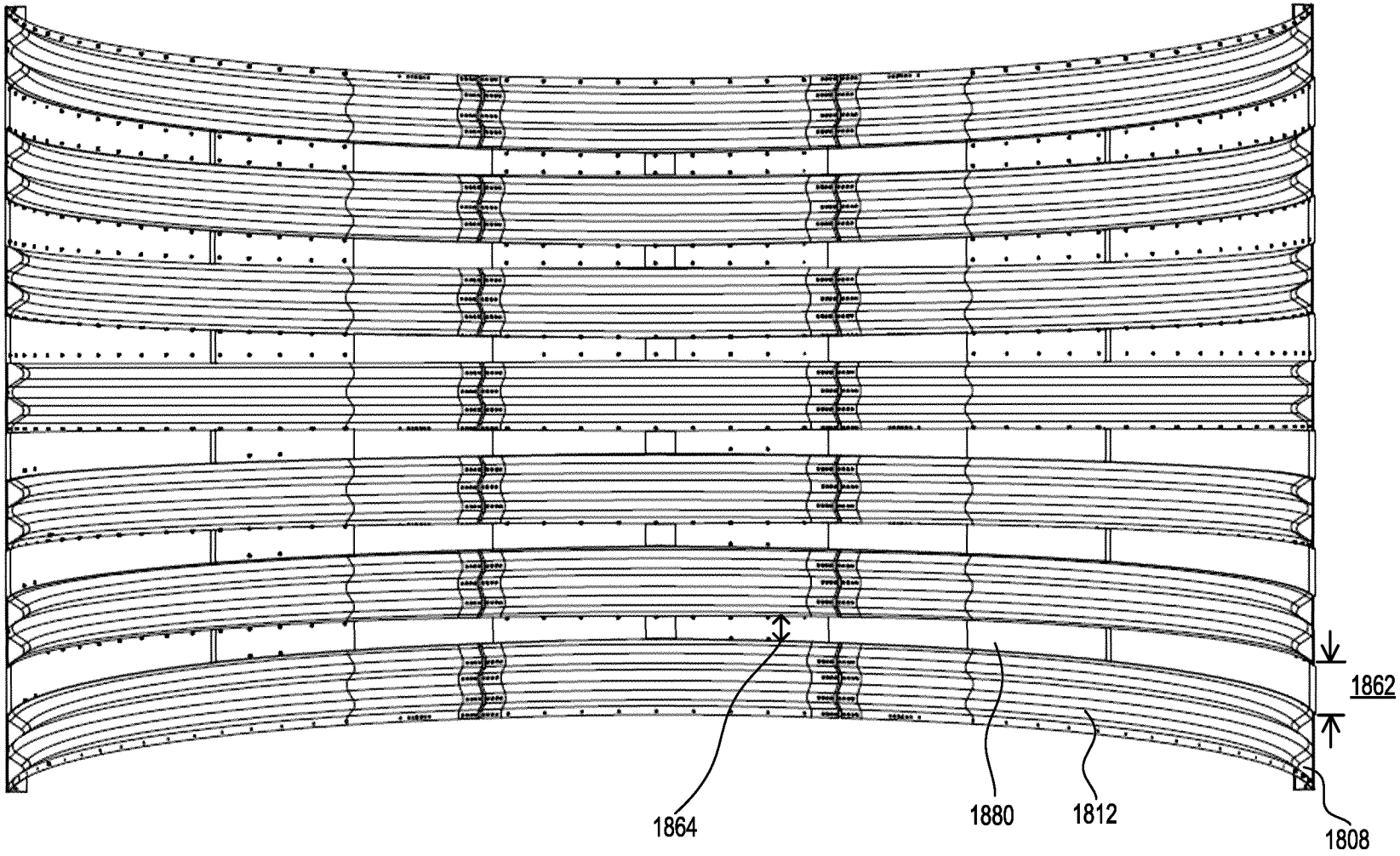
FIG. 19 illustrates a top plan view of the buried structure of FIG. 18.

To illustrate, reference is made to FIG. 19, which illustrates a top plan view of the buried structure 1800 of FIG. 18. In FIG. 19, the separation distance 1862 (proximal to the structural plate terminations 1808) between circumferential structural ring edges of adjacent structural rings is greater than the separation distance 1864 between circumferential structural ring edges of adjacent structural edges distal (e.g., near the structure crown) from the structural plate terminations 1808. The illustrated buried structure 1800 may be configured to extend to follow a changing or altering grade.

Figure 20:
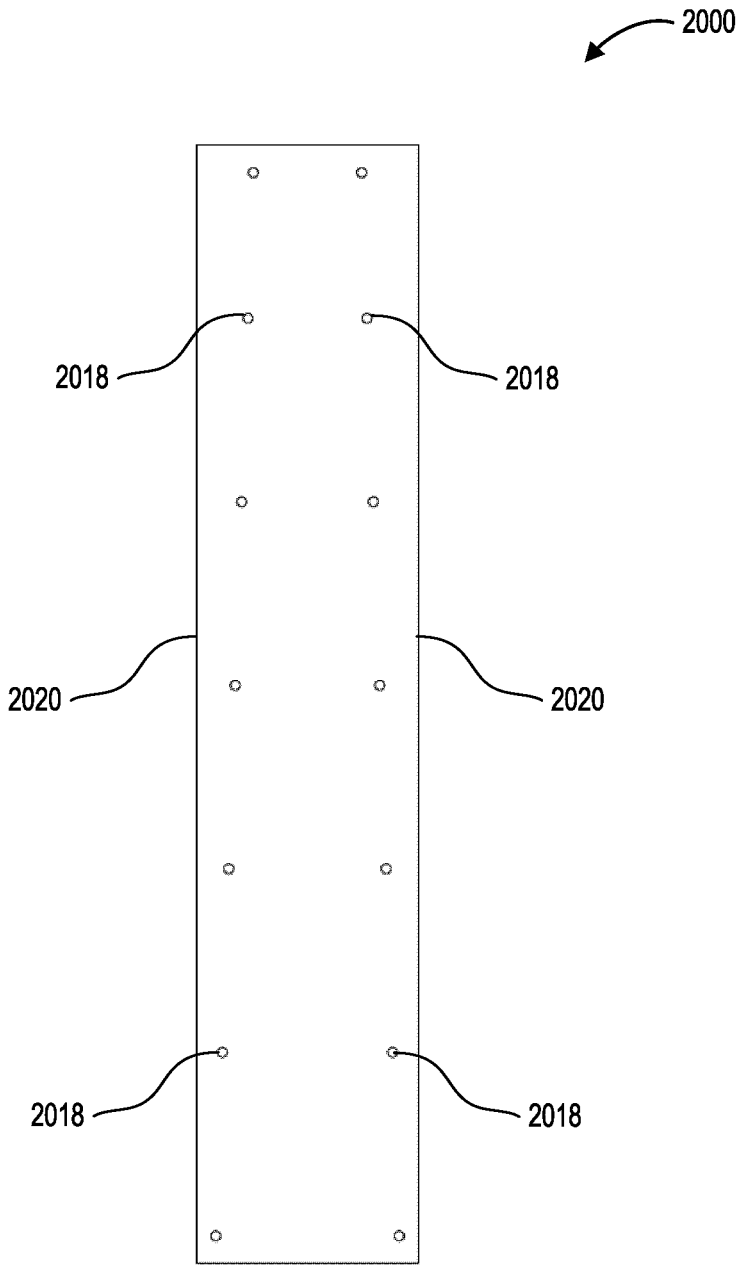
FIG. 20 illustrates a plan view of a taper plate, in accordance with embodiments of the present disclosure.

Reference is made to FIG. 20, which illustrates a plan view of a taper plate 2000, in accordance with embodiments of the present disclosure. The taper plate 2000 may be substantially rectilinear in shape, and the one or more taper apertures 2018 may be located at positions progressively inward of the taper plate edges 2020. In some scenarios, the one or more aperture positioning may be at positions inward of taper plate edges 2020 and determined based on dimensions for providing a buried structure extending a non-linear path.

In some scenarios, the one or more apertures may be configured at a location about the taper plate while an installation technician is at or near an installation site. As such, there may be efficiencies in adapting a rectangular taper plate for securing adjacent structural plates in a non-overlapping configuration along circumferential edges at an on-site installation location. Such examples of adapting a substantially rectangular-shaped taper plate may reduce the quantity of custom taper plate dimension variations to be manufactured.

Figure 21:
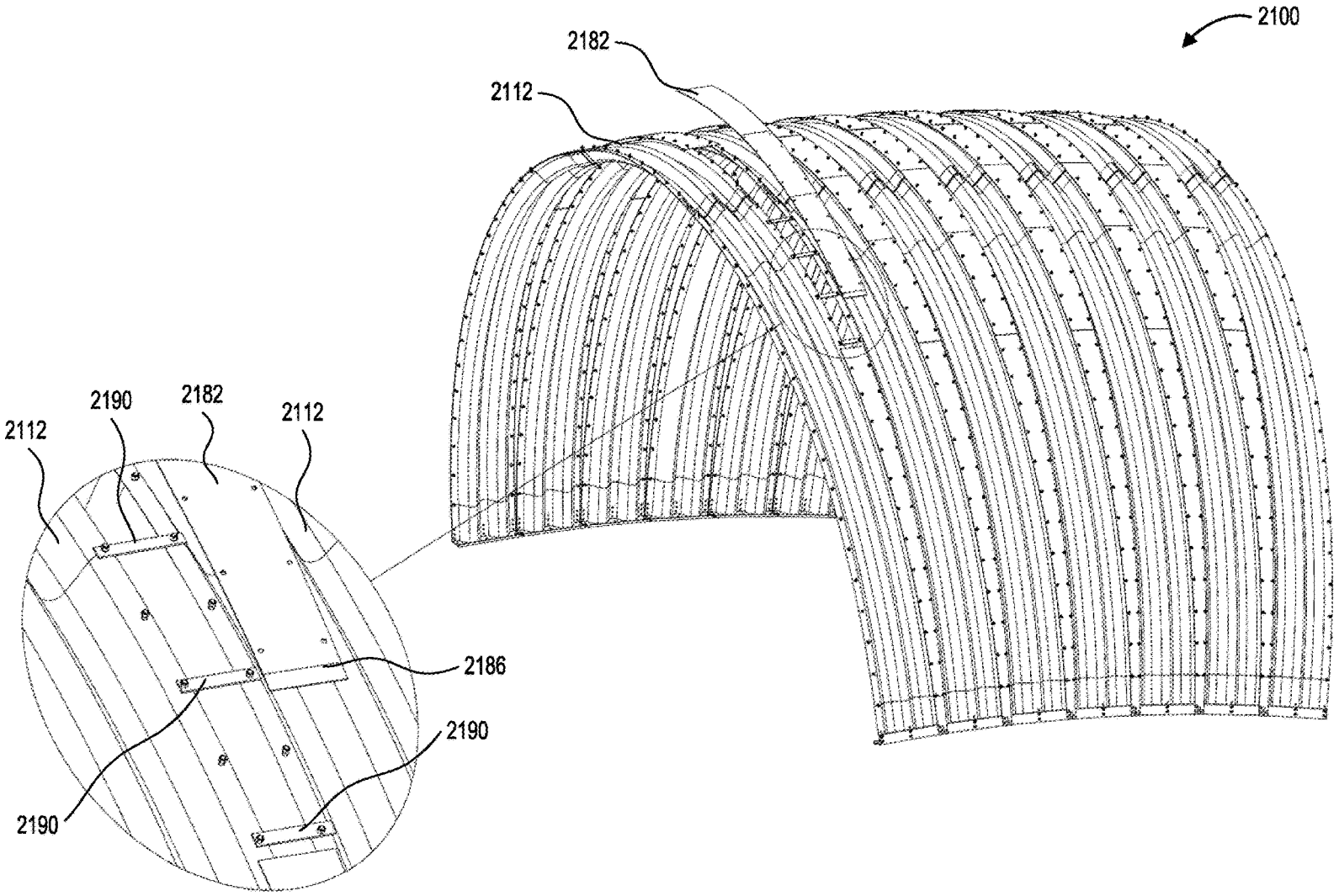
FIG. 21 illustrates a perspective view of a buried structure, in accordance with embodiments of the present disclosure.

Reference is made to FIG. 21, which illustrates a perspective view of a buried structure 2100, in accordance with embodiments of the present disclosure. The buried structure 2100 may include features similar to the buried structure 1600 described with reference to FIG. 16.

The buried structure 2100 includes a plurality of structural rings 2112, where the respective structural rings 2112 may include a plurality of structural plates coupled to adjacent structural plates at longitudinal plate edges. The respective structural rings 2112 may extend from a structural plate termination on one side of the buried structure 2100 to a corresponding structural plate termination on a second side of the buried structure 2100.

In FIG. 21, the respective structural rings 2112 may be interconnected with an adjacent structural ring by a plurality of taper plates 2182. The taper plates 2182 may be positioned to overlap at longitudinal taper plate edges 2186.

In some embodiments described in the present disclosure, taper plates may be constructed of metal materials, and may have a plate thickness dimension that is smaller than a plate thickness dimension of the structural plates.

It may be desirable to provide taper plates constructed of alternate materials, such as non-metal materials. In some embodiments, the taper plates 2182 may be constructed of non-metal materials. For example, the taper plates 2182 may be constructed with at least one of rubber, fiberglass, or plastics, among other example materials. Example non-metal materials may be selected to prevent dirt or other materials from seeping through the buried structure.

In some embodiments, the buried structure 2100 may include longitudinal stiffener members 2190 configured to fasten to respective circumferential structural plate edges. The longitudinal stiffener members 2190 may be configured for providing a separation distance between adjacent structural rings 2112. In some embodiments, the longitudinal stiffener member 2190 dimension may be configured such that a series of longitudinal stiffener members 2190 may provide a progressively decreasing separation distance between the adjacent structural rings 2112.

In the embodiments illustrated in FIG. 21, once the longitudinal stiffener members 2190 are fastened to the circumferential structural plate edges, one or more taper plates 2182 may be overlaid to interconnect a pair of adjacent structural rings 2112 along respective circumferential structural plate edges.

In some embodiments, the longitudinal stiffener members 2190 may be fastened on an outer surface of the buried structure 2100 or on an inner surface of the buried structure 2100.

The term "connected" or "coupled to" may include both direct coupling (in which two elements that are coupled to each other contact each other) and indirect coupling (in which at least one additional element is located between the two elements).

Although the embodiments have been described in detail, it should be understood that various changes, substitutions and alterations can be made herein without departing from the scope. Moreover, the scope of the present disclosure is not intended to be limited to the particular embodiments of the process, machine, manufacture, composition of matter, means, methods and steps described in the specification.

As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

The description provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As can be understood, the examples described above and illustrated are intended to be exemplary only.

What is claimed is:

1. A buried structure comprising:

a pair of structural plates having corrugations extending transversely along a longitudinal direction of the buried structure; and a taper member configured to interconnect, via circumferential taper member edges, the pair of structural plates along respective circumferential structural plate edges, the taper member having a taper member width progressively decreasing from a first longitudinal taper member edge to a second longitudinal taper member edge, wherein the buried structure is configured to extend along the longitudinal direction in a non-linear path based on a separation distance between the adjacent circumferential structural plate edges of the respective structural plates corresponding to the progressively decreasing taper member width, and wherein the taper member is substantially un-corrugated.

2. The buried structure of claim 1, wherein the taper member includes a plurality of taper plates respectively sized to have taper plate widths progressively decreasing along the taper plate length, and wherein respective taper plates include a longitudinal taper plate edge positioned at an overlap interface with another longitudinal taper plate edge of an adjacent taper plate.

3. The buried structure of claim 2, wherein the respective taper plates are unfastened at the overlap interface from the adjacent taper plate, and wherein the taper member is fastened at respective circumferential taper member edges to circumferential structural plate edges of adjacent structural plates.

4. The buried structure of claim 2, wherein at least one longitudinal taper plate edge includes a transition feature having at least one of a raised or recessed edge.

5. The buried structure of claim 1, wherein the taper member includes a combination of substantially planar taper plates and radiused along the taper member length to correspond to a radius of the structural plates.

6. The buried structure of claim 1, wherein the taper member is configured to have a substantially trapezoidal shape.

7. The buried structure of claim 1, wherein the respective structural plates include a plurality of structural plate apertures spaced along circumferential structural plate edges, and wherein the taper member includes a plurality of taper apertures spaced along circumferential taper member edges, and wherein the taper apertures have a taper aperture spacing corresponding to a structural plate aperture spacing.

8. The buried structure of claim 1, comprising at least one tie-back member coupled to the taper member proximal to a foundation of the buried structure, the at least one tie-back member exerting force away from the buried structure.

9. The buried structure of claim 1, wherein the taper member is overlaid to interface with circumferential structural plate edges on an exterior side of the buried structure.

10. A taper member for securing a pair of structural plates for constructing a buried structure, the structural plates having corrugations extending transversely along a longitudinal direction of the buried structure, the taper member comprising:

a first taper plate configured to interconnect, via circumferential taper member edges, the pair of structural plates along respective circumferential structural plate edges, the first taper plate having a taper plate width progressively decreasing from a first longitudinal taper plate edge to a second longitudinal taper plate edge; and an adjacent taper plate having an adjacent longitudinal taper plate edge positioned at an overlap interface with the second longitudinal taper plate edge, wherein the adjacent taper plate is configured to interconnect with the pair of structural plates along the respective circumferential structural plate edges, and wherein the respective taper plates are unfastened at the overlap interface from the adjacent taper plate.

11. The taper member of claim 10, wherein the taper member is fastened at respective circumferential taper member edges to circumferential structural plate edges of adjacent structural plates.

12. The taper member of claim 10, wherein the first taper plate and the adjacent taper plate are substantially planar plates and radiused along the taper member length to correspond to a radius of the structural plates.

13. The taper member of claim 10, wherein the first taper plate or the adjacent taper plate is configured to have a substantially trapezoidal shape.

14. The taper member of claim 10, wherein the taper member is overlaid to interface with circumferential structural plate edges on an exterior side of the buried structure, and wherein the taper member is laid to interface with circumferential structural plate edges on an interior side of the buried structure.

15. A method of constructing a buried structure comprising:

constructing a plurality of structural rings, the structural rings including structural plates coupled at longitudinal structural plate edges of an adjacent longitudinal structural plate edge, the structural plates having corrugations extending transversely along a longitudinal direction of the buried structure;

positioning the plurality of structural rings adjacent to another structural ring; and positioning a taper member to interconnect, via circumferential taper member edges, the pair of structural plates along respective circumferential structural plate edges, the taper member having a taper member width progressively decreasing from a first longitudinal taper member edge to a second longitudinal taper member edge, wherein the buried structure is configured to extend along the longitudinal direction in a non-linear path based on a separation distance between the adjacent circumferential structural plate edges of the respective structural plates corresponding to the progressively decreasing taper member width.

16. The method of constructing a buried structure of claim 15, comprising:

positioning a plurality of taper plates respectively sized to have taper plate widths progressively decreasing along the taper plate length for assembling the taper member, wherein respective taper plates include a longitudinal taper plate edge positioned at an overlap interface with another longitudinal taper plate edge of an adjacent taper plate.

17. The method of constructing a buried structure of claim 16, wherein the respective taper plates are unfastened at the overlap interface from the adjacent taper plate, and wherein the method comprising fastening at respective circumferential taper member edges the taper member to circumferential structural plate edges of adjacent structural plates.

18. The method of constructing a buried structure of claim 15, wherein taper member includes a combination of substantially planar taper plates and radiused along the taper member length to correspond to a radius of the structural plates.

19. The method of constructing a buried structure of claim 15, wherein the respective structural plates include a plurality of structural plate apertures spaced along circumferential structural plate edges, wherein the taper member includes a plurality of taper apertures spaced along circumferential taper member edges, wherein the taper apertures have a taper aperture spacing corresponding to a structural plate aperture spacing, and wherein the method comprising: inserting fasteners within respectively aligned structural plate apertures and taper apertures to fasten, via the taper member, the pair of structural plates along respective circumferential structural plate edges.

* * * * *